US012454889B2

(12) United States Patent
Alsulaim et al.

(10) Patent No.: US 12,454,889 B2
(45) Date of Patent: Oct. 28, 2025

(54) HYBRID BAILER

(71) Applicant: SAUDI ARABIAN OIL COMPANY, Dhahran (SA)

(72) Inventors: Abdullah T. Alsulaim, Dammam (SA); Fahad M. Al-Ajmi, Dhahran (SA); Saad Hamid, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 111 days.

(21) Appl. No.: 18/504,294

(22) Filed: Nov. 8, 2023

(65) Prior Publication Data

US 2025/0146410 A1 May 8, 2025

(51) Int. Cl.
*E21B 49/02* (2006.01)
*E21B 27/02* (2006.01)

(52) U.S. Cl.
CPC ..... *E21B 49/02* (2013.01); *E21B 27/02* (2013.01)

(58) Field of Classification Search
CPC ..... E21B 49/02; E21B 27/00; E21B 27/02
See application file for complete search history.

(56) References Cited

U.S. PATENT DOCUMENTS 1,257,176 A 2/1918 Bell
RE19,679 E * 8/1935 Cavins ..... E21B 27/00 166/163
2,040,413 A 5/1936 Tarkington
2,649,917 A * 8/1953 Simmons ..... E21B 27/00 166/107
3,090,441 A 5/1963 Smink et al.
3,583,504 A 6/1971 Aalund
5,348,086 A * 9/1994 Trout ..... E21B 31/16 166/99
5,623,993 A * 4/1997 Van Buskirk ..... E21B 43/14 166/292
5,810,410 A * 9/1998 Arterbury ..... E21B 31/12 294/86.17
8,061,053 B2 11/2011 Gillan
9,771,771 B2 9/2017 Williams et al.
(Continued)

FOREIGN PATENT DOCUMENTS

CN 211474060 U 9/2020
WO 1998050675 A1 11/1998

*Primary Examiner* — Shane Bomar
(74) *Attorney, Agent, or Firm* — Osha Bergman Watanabe & Burton LLP

(57) ABSTRACT

An apparatus for deployment in a conduit of a tubular having an obstruction includes a fish neck connected to a deployment device configured to deploy the fish neck into the conduit of the tubular. The apparatus also includes a sand bailer connected to the fish neck. The sand bailer has a diameter larger than a diameter of the fish neck and the sand bailer is configured to obtain a sample of the obstruction by creating a suction pressure within the sand bailer. The apparatus further includes an outer sleeve movable between a first position and a second position. The first position comprises the outer sleeve concentrically disposed around the sand bailer and the second position comprises the outer sleeve concentrically disposed around the fish neck after an interaction between the outer sleeve and the obstruction. The outer sleeve comprising a plurality of panels connected to one another by a plurality of stretchable elements.

20 Claims, 20 Drawing Sheets

(56) References Cited

U.S. PATENT DOCUMENTS

| | | | | |
|---|---|---|---|---|
| 10,822,882 | B2 | 11/2020 | Brown | |
| 12,024,994 | B1 * | 7/2024 | Alsulaim | E21B 47/006 |
| 2016/0084064 | A1 * | 3/2016 | Clemens | E21B 47/09<br>166/301 |
| 2023/0175335 | A1 | 6/2023 | Hitchcock et al. | |
| 2024/0344445 | A1 * | 10/2024 | Alsulaim | E21B 47/006 |

* cited by examiner

HYBRID BAILER

BACKGROUND

In the oil and gas industry, hydrocarbons are located in porous rock formations beneath the Earth's surface. Hydrocarbons are accessed by drilling wells into the formation(s). A well is a series of concentric holes drilled into the surface of the Earth where each hole is supported by a casing string cemented in place. In order to produce the hydrocarbons, a production string is often run and set within the inner-most casing string. A production string is a series of tubulars connected to one another. The production string is used to provide a conduit for hydrocarbon migration to the surface. Often, other production equipment, such as pumps and separators, are included in the production string to aid production of the hydrocarbons.

During the life of a well, the well may require one or more wellbore interventions to maintain the well, secondarily complete the well, or replace downhole equipment. Most wellbore interventions require through-tubing access to the well. Through-tubing access is a method that includes running tools through the inside of the production tubing to perform operations downhole. Prior to running through-tubing tools, it is important to drift the production tubing. Drifting conventionally consists of running a tool, having a diameter assumed to be the accessible inner diameter of the production tubing, through the inside of the production tubing to determine the wellbore accessibility, i.e., the maximum size tool that may be run through the production tubing. Often, the drifting tool is unable to be run through the entirety of the production tubing due to obstructions.

An obstruction may be a signal of a potential tubular collapse, broken off tools, debris, or built-up scale. Identification of an obstruction is very difficult due to the decreased visibility, harshness, and depth of the downhole environment. Once an obstruction is identified, multiple runs of progressively smaller drift tools are necessary to determine the extent of the obstruction. Multiple runs of drift tools are costly, time consuming, and invite more time for well control incidents to occur.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods systems, and apparatuses for detecting and obtaining a sample of an obstruction in a tubular. The apparatus is for deployment in a conduit of the tubular having the obstruction and includes a fish neck connected to a deployment device configured to deploy the fish neck into the conduit of the tubular. The apparatus also includes a sand bailer connected to the fish neck. The sand bailer has a diameter larger than a diameter of the fish neck and the sand bailer is configured to obtain a sample of the obstruction by creating a suction pressure within the sand bailer. The apparatus further includes an outer sleeve movable between a first position and a second position. The first position comprises the outer sleeve concentrically disposed around the sand bailer and the second position comprises the outer sleeve concentrically disposed around the fish neck after an interaction between the outer sleeve and the obstruction. The outer sleeve comprising a plurality of panels connected to one another by a plurality of stretchable elements.

The method includes running a deployment device connected to a fish neck and a sand bailer into the conduit of the tubular, wherein the sand bailer has a diameter larger than a diameter of the fish neck, positioning an outer sleeve, comprising a plurality of stretchable elements connecting a plurality of panels to one another, in a first position, wherein the first position comprises the outer sleeve disposed concentrically around the sand bailer, detecting the obstruction by shifting the outer sleeve from the first position to a second position due to an interaction between the obstruction and the outer sleeve, wherein the second position comprises the outer sleeve concentrically disposed around the fish neck, and obtaining a sample of the obstruction by creating a suction pressure within the sand bailer.

The system includes a deployment device connected to a fish neck and a sand bailer. The sand bailer has a diameter larger than a diameter of the fish neck and the sand bailer is configured to obtain a sample of the obstruction by creating a suction pressure within the sand bailer. The systems further includes a first cylindrical sleeve stretchable to be disposed concentrically around the sand bailer. The first cylindrical sleeve is configured to disconnect from a first underlay due to a force of impact created by an interaction with the obstruction, and contract and shift around the fish neck. The system detects the obstruction by a contraction of the first cylindrical sleeve.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Herein, the term "cylindrical" is not meant to be limiting and may be used to not only mean a form or a shape of a cylinder, but also a form or a shape of a truncated cone.

When obstructions are faced while drifting tubing, multiple runs of progressively smaller drift tools are necessary to determine the extent and size of the obstruction. Multiple runs of drift tools are costly, time consuming, and invite more time for well control incidents to occur. Furthermore, when the obstruction is so large it is unable to be drifted, a separate tool must be run downhole to obtain a sample of the obstruction in order to determine how to effectively remove the obstruction from the tubing. Accordingly, a tool that is able to reduce the number of drifting runs to determine the accessible inner diameter of the tubular and obtain a sample of an obstruction is beneficial.

As such, embodiments disclosed herein include apparatuses, systems, and methods for detecting an obstruction in a conduit of a tubular, determining the accessible inner diameter of the tubular, and obtaining a sample of the obstruction using an apparatus. The apparatus has the ability to change in size until the apparatus is small enough to bypass the obstruction. When the apparatus is pulled to the surface, the accessible inner diameter of the tubular is determined by the reduced size of the apparatus. Furthermore, if the obstruction is so large that the apparatus is unable to reduce in size to pass it, the apparatus is able to take a sample of the obstruction prior to being removed from the tubular.

Figure 1:
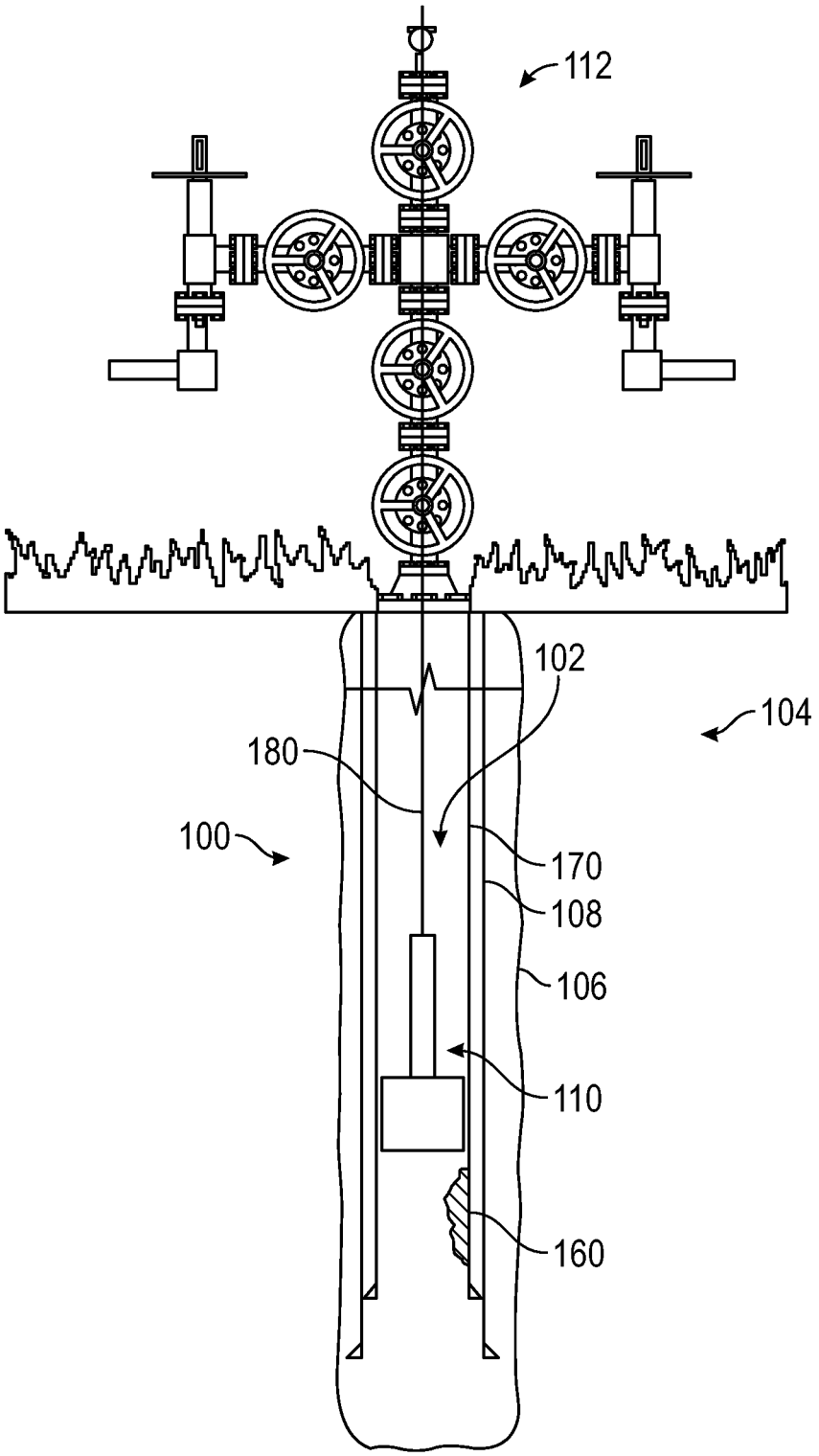
FIG. 1 shows a schematic view of a system in accordance with one or more embodiments.

FIG. 1 shows a schematic cross-sectional view illustrating a system 100 for detecting an obstruction 160 in a conduit 102 of a tubular 170 located in a well 104 in accordance with one or more embodiments. The well 104 shown in FIG. 1 is shown for exemplary purposes and is not meant to be limiting. A well having any type of well schematic, design, or trajectory may be used herein without departing from the scope of the disclosure.

In accordance with one or more embodiments, the well 104 includes a wellbore 106 drilled into the surface of the Earth. A casing string 108 is cemented in place in the wellbore 106. A tubular 170 is disposed within the casing string 108. The tubular 170 may be a production string in accordance with one or more embodiments. The well 104 further includes a production tree 112 housing the surface-extending portion of the casing string 108 and the surface-extending portion of the tubular 170. The production tree 112 is a series of spools and valves that are used to enable production of fluids from the well 104 and enable downhole access to the well 104. Herein, the term "production tree 112" may encompass the wellhead and the tubing head without departing from the scope of the disclosure herein.

The system 100 includes a deployment device 180 connected to an apparatus 110. The deployment device 180 is used to raise and lower the apparatus 110 inside of the tubular 170. The deployment device 180 may be any type of deployment device known in the art, such as coiled tubing, slickline, or wireline. An input may direct the deployment device 180 to extend the apparatus 110 further into the tubular 170.

The system 100 detects the presence of the obstruction 160 in the tubular when the apparatus 110 hits the obstruction 160, and a force of impact, created by the interaction between the obstruction 160 and the apparatus 110, reduces the size of the apparatus 110. The apparatus 110 is further outlined in FIGS. 3A-FIG. 8D.

Figure 2:
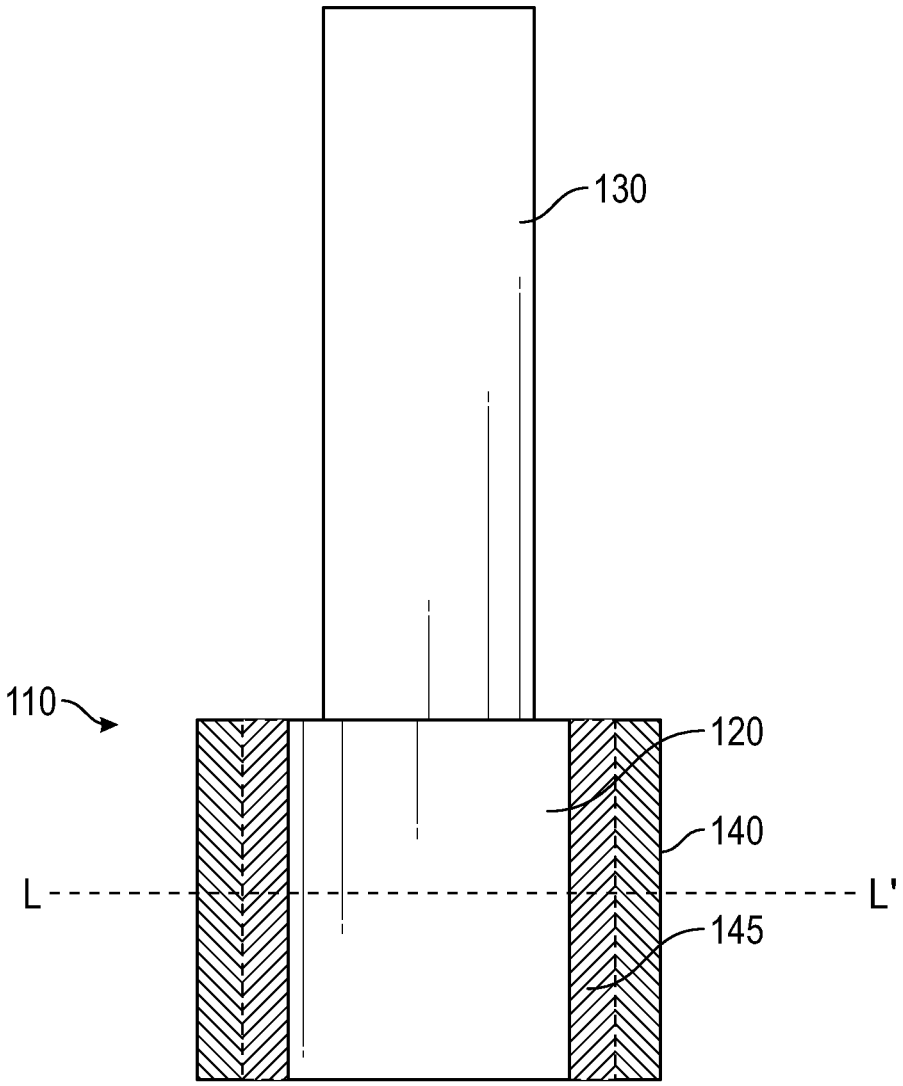
FIG. 2 shows a longitudinal cross-section view of an apparatus in accordance with one or more embodiments.

FIG. 2 shows a longitudinal cross-section view of the apparatus 110 in accordance with one or more embodiments. The apparatus 110 may include a first cylindrical rod 130, a second cylindrical rod 120, and one or more stretchable, cylindrical sleeves. Embodiments of the apparatus 110 shown herein include two stretchable, cylindrical sleeves: an outer sleeve 140 and an inner sleeve 145. However, the disclosure is not meant to be limiting to two sleeves, rather, the apparatus 110 may include one or more stretchable, cylindrical sleeves (as described by outer sleeve 140 and inner sleeve 145) without departing from the scope of the disclosure herein.

In accordance with one or more embodiments, the first cylindrical rod 130 and the second cylindrical rod 120 are formed in the shape of a cylinder and may have a solid body or a hollow body without departing from the scope of the disclosure herein. Furthermore, the first cylindrical rod 130 and the second cylindrical rod 120 may be made of any durable material that can withstand downhole conditions, such as a metal alloy. In further embodiments, the first cylindrical rod 130 has a smaller outer diameter than the second cylindrical rod 120. The first cylindrical rod 130 and the second cylindrical rod 120 may be connected to one another using any connection known in the art, such as a welded connection, a threaded connection, etc. In other embodiments, the first cylindrical rod 130 and the second cylindrical rod 120 may be machined as one component.

In accordance with one or more embodiments, the outer sleeve 140 and the inner sleeve 145 are extendable/stretchable and are concentrically disposed around the second cylindrical rod 120. In accordance with one or more embodiments, the inner sleeve 145 is located between the outer sleeve 140 and the second cylindrical rod 120. That is, the outer sleeve 140 has a larger diameter than the inner sleeve 145 when the outer sleeve 140 and the inner sleeve 145 are concentrically disposed around the second cylindrical rod 120.

The make-up of the outer sleeve 140 and the inner sleeve 145 and how the outer sleeve 140 and the inner sleeve 145 are connected to one another/disposed around the second cylindrical rod 120 is outlined below in FIGS. 7-8D. The shapes of the second cylindrical rod 120, the outer sleeve 140, and the inner sleeve 145 may be modified in response to a change in a structural design of the apparatus 110 without departing from the scope of the disclosure herein.

In accordance with one or more embodiments, the outer sleeve 140 is movable between a first position and a second position. The first position of the outer sleeve 140 is shown in FIG. 2. The first position of the outer sleeve 140 includes the outer sleeve 140 concentrically disposed around the second cylindrical rod 120. The second position of the outer sleeve 140 includes the outer sleeve 140 concentrically disposed around the first cylindrical rod 130 after an interaction between the outer sleeve 140 and an object, such as the obstruction 160 shown in FIG. 1. The movement between the first position and the second position of the outer sleeve 140 is shown in detail in FIGS. 3A to 3D below.

In further embodiments, there may be more than two cylindrical sleeves (a second to the n-th cylindrical sleeves) wrapped concentrically around one another and around the second cylindrical rod 120 without departing from the scope of the disclosure herein. N is an integer greater than 2, and the second to n-th cylindrical sleeves are able to disconnect from a second to an n-th underlays due to a force of impact created by the interaction with the obstruction 160 and contract and shift around the first cylindrical rod 130.

Particularly, FIGS. 3A to 3D show perspective views of the apparatus 110 and illustrates changes in the shape and/or position of the outer sleeve 140 and the inner sleeve 145 in accordance with one or more embodiments. The apparatus 110 is shown in a tubular 170 having an obstruction 160, as outline above in FIG. 1. Components shown in FIGS. 3A to 3D that are described in previous figures have not been redescribed for purposes of readability and have the same description and function as outlined formerly.

Figure 3A:
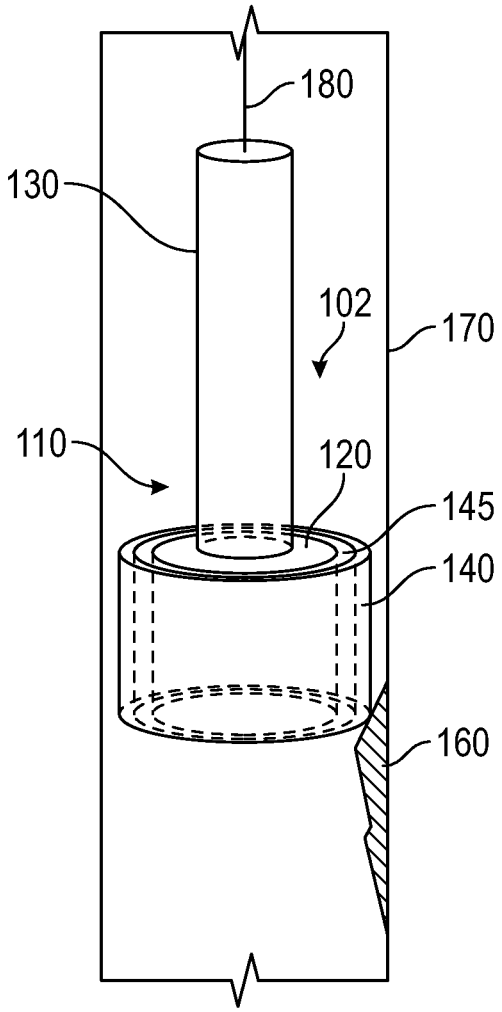
FIGS. 3A to 3D show perspective views of an apparatus in accordance with one or more embodiments.

Specifically, FIG. 3A illustrates the configuration of the apparatus 110 in the first position and before the apparatus 110 interacts with the obstruction 160. The deployment device 180 is attached to the apparatus 110 to lower or pull the apparatus 110 into or from the tubular 170. In particular, the deployment device 180 is connected to the first cylindrical rod 130. The deployment device 180 is connected to the first cylindrical rod 130 using any connection known in the art. For example, the deployment device 180 may have a bottom hole assembly that is connected to the first cylindrical rod 130. In other embodiments, the deployment device 180 may have a cable head that is used to connect the first cylindrical rod 130 to the deployment device 180.

In accordance with one or more embodiments, the apparatus 110 includes the first cylindrical rod 130, the second cylindrical rod 120, the outer sleeve 140, and the inner sleeve 145. The inner sleeve 145 is stretched to encircle the second cylindrical rod 120. In further embodiments, the outer sleeve 140 may also be stretched to encircle the inner sleeve 145. Herein, the term stretching may refer to extending, or enlarging, the circumference and diameter of the inner sleeve 145 and the outer sleeve 140.

The inner sleeve 145 and the outer sleeve 140 may be stretched using stretchable elements. The stretchable elements may be any element that allows the circumference and diameter of the inner sleeve 145 and the outer sleeve 140 to expand. For example, the stretchable elements may include coils or elastic bands embedded in the surface of the sleeves, a foldable sheet, or stackable panels. In accordance with one or more embodiments, the inner sleeve 145 and the outer sleeve 140 may be both stretchable and retractable.

To realize sufficient stretchability but also reversibility of the expansion of the inner sleeve 145 and the outer sleeve 140, the extensible components may be made of shear-resistant infrangible materials. Further, a suitable element (mechanical pins, hooks, adhesive agents, electromagnetic propensities, etc.) may be incorporated to allow attachment of the stretched outer sleeve 140 and inner sleeve 145 to their underlays (the inner sleeve 145 and the second cylindrical rod 120, respectively).

When the outer sleeve 140 hits the obstruction 160 while the apparatus 110 is being lowered into the tubular 170 using the deployment device 180, a force of the impact created by the interaction breaks the attachment of the outer sleeve 140 to the inner sleeve 145. Furthermore, the force of impact may drive the outer sleeve 140 up-hole and away from the inner sleeve 145, as shown in FIG. 3B.

Figure 3B:
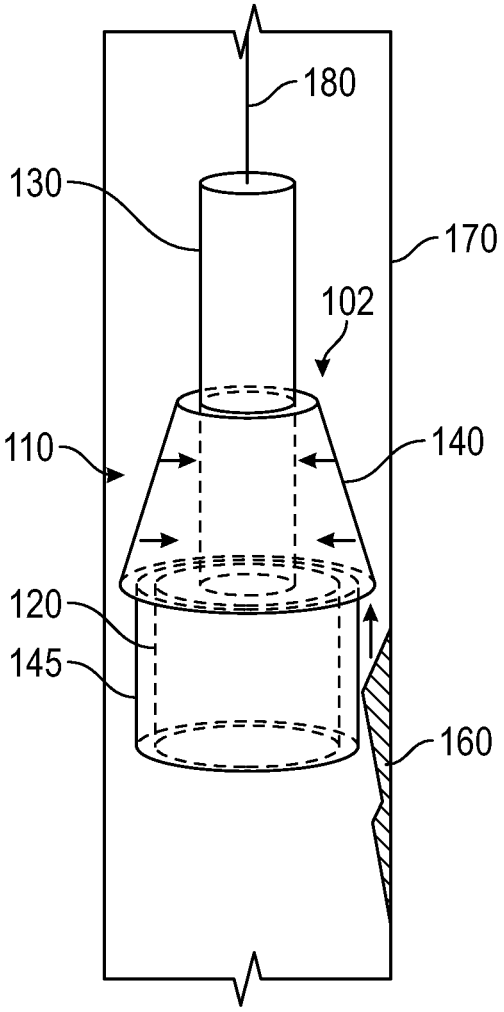

FIG. 3B shows a transient configuration of the apparatus 110 according to one or more embodiments. FIG. 3B shows the contraction and shifting of the outer sleeve 140 after the interaction with the obstruction 160. FIG. 3B also shows the transition of the outer sleeve 140 between the first position and the second position.

In accordance with one or more embodiments and depending on the size of the obstruction 160, the force of impact from the interaction between the outer sleeve 140 and the obstruction 160 disconnects only the outer sleeve 140 from the inner sleeve 145, without causing detachment of inner sleeve 145 from the second cylindrical rod 120. That is, the suitable mode of attachment that connects the inner sleeve 145 to the second cylindrical rod 120 is not disturbed by the obstruction 160.

In accordance with one or more embodiments, the outer sleeve 140 begins to move from the second cylindrical rod 120 towards the first cylindrical rod 130 due to the force of the impact from the collision. Due to the first cylindrical rod 130 having a smaller diameter than the second cylindrical rod 120 and the nature of the stretchable elements, the outer sleeve 140 begins to shrink after the attachment to the inner sleeve 145 is broken. FIG. 3B shows that the outer sleeve 140 may form a shape similar to a truncated cone while transitioning between the first position and the second position.

Figure 3C:
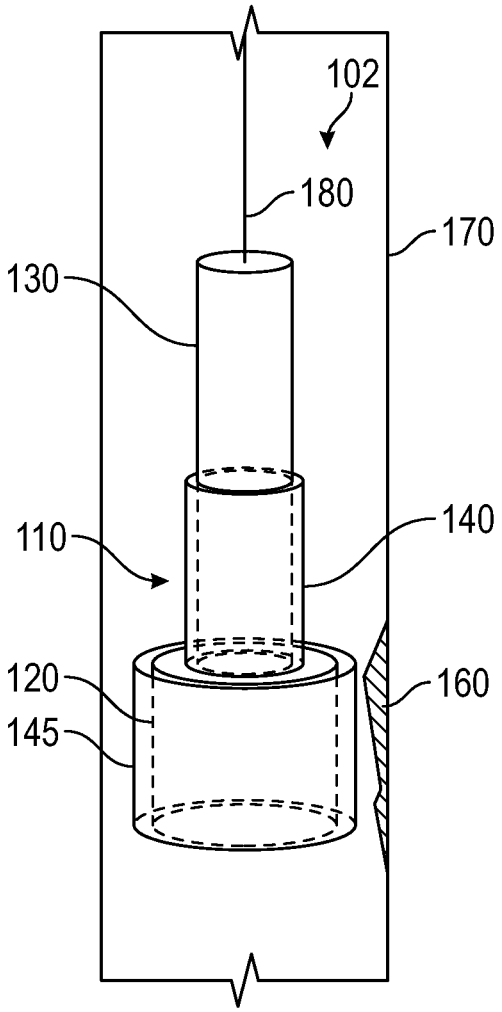

FIG. 3C shows the apparatus 110 after the collision with the obstruction 160 in accordance with one or more embodiments. FIG. 3C also shows the outer sleeve 140 in the second position. In accordance with one or more embodiments, the outer sleeve 140 moves to encircle the first cylindrical rod 130 upon receiving the force of impact, in the form of kinetic energy, from the interaction with the obstruction 160. When stretchable materials are used in the outer sleeve 140, the stored elastic potential energy within the stretchable materials may be utilized to propel the movement of the outer sleeve 140 towards the first cylindrical rod 130, which has a diameter that is smaller than a diameter of the second cylindrical rod 120.

The system 100 may detect the presence and/or approximate location of the obstruction 160 by any means known in the art. For example, the deployment device 180 may have a depth chart at the surface tracking the depth of the apparatus 110 as it is lowered or raised in the tubular 170. Furthermore, the deployment device 180 may have a sensor at the surface that tracks the amount of tension and slack that is seen in the deployment device 180. Thus, when the apparatus 110 interacts with the obstruction 160, an amount of slack may be seen at the surface. The tension/slack sensor and the depth tracker may be calibrated in a computer. Thus, an operator may compare the depth to the time slack was seen across the deployment device 180 in order to note at what depth the obstruction is located.

After the apparatus 110 has competed the drift of the tubular 170 and is retrieved at the surface, the size of the apparatus 110 may indicate the accessible inner diameter of the tubular 170. That is, an operator may note how many sleeves were broken away from their underlays which indicates the extend of the obstruction's 160 size within the tubular 170.

Figure 3D:
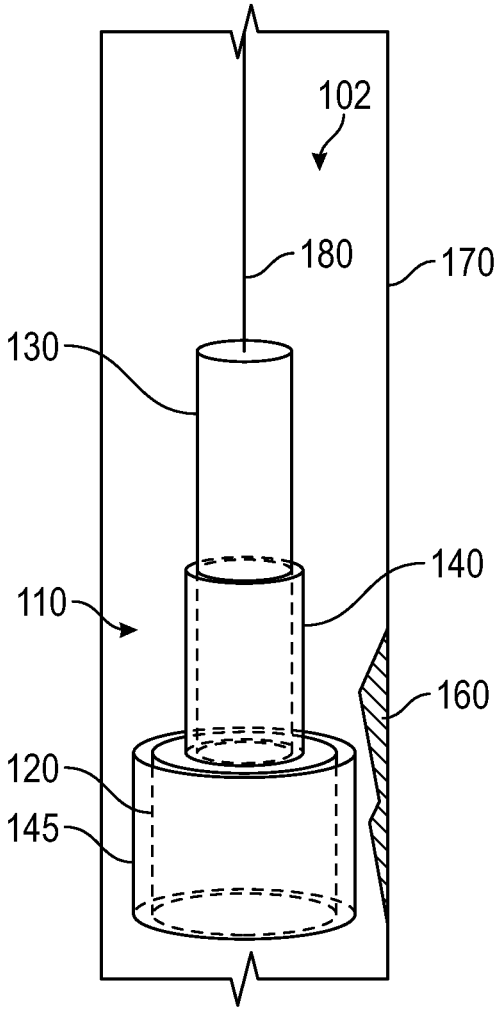

FIG. 3D shows the advancement of the apparatus 110 after the outer sleeve's 140 contraction in accordance with one or more embodiments. For example, the apparatus 110 may successfully pass the site of the obstruction 160, if the obstruction 160 does not extend to the outer surface of the inner sleeve 145 and the outer sleeve 140 has been contracted due to the interaction with the obstruction 160.

FIGS. 4A to 4F show perspective views of the apparatus 110 and illustrate changes in the shapes and/or positions of the outer sleeve 140 and the inner sleeve 145 in accordance with one or more embodiments. Specifically, FIGS. 4A to 4F show the obstruction 160 having a size large enough to interact with both the outer sleeve 140 and the inner sleeve 145.

In accordance with one or more embodiments, the apparatus 110 is controlled by the deployment device 180 and advances in the tubulars 170. The circumferences of the inner sleeve 145 and the outer sleeve 140 are extendable when springs embedded into the inner sleeve 145 and outer sleeve 140 are stretched. In other embodiments, if folded sheets or panels that make up the inner sleeve 145 and outer sleeve 140 are pulled out, the circumference and the diameter of the inner sleeve 145 and outer sleeve 140 may be lengthened. Components constituting the surface of the outer sleeve 140 and the inner sleeve 145 may be made of shear-resistant infrangible materials.

Figure 4A:
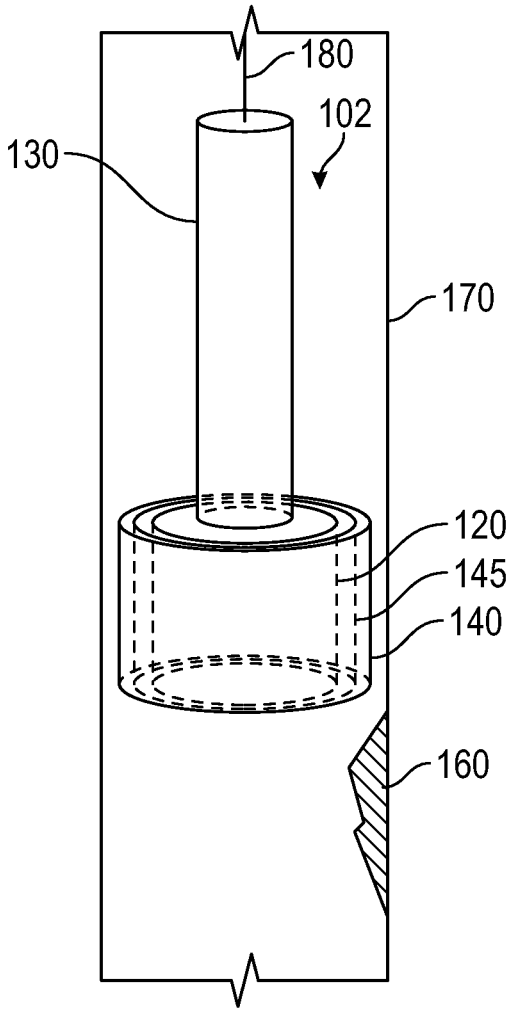
FIGS. 4A to 4F show perspective views of an apparatus in accordance with one or more embodiments.

FIGS. 4A to 4F show the outer sleeve 140 moving between the first position and the second position and the inner sleeve 145 moving between a third position and a fourth position. In accordance with one or more embodiments, the first position includes the outer sleeve 140 concentrically disposed around the second cylindrical rod 120 as shown in FIG. 4A. The second position include the outer sleeve 140 concentrically disposed around the first cylindrical rod 130 after an interaction between the outer sleeve 140 and the obstruction 160 as shown in FIGS. 4C to 4F.

Figure 4B:
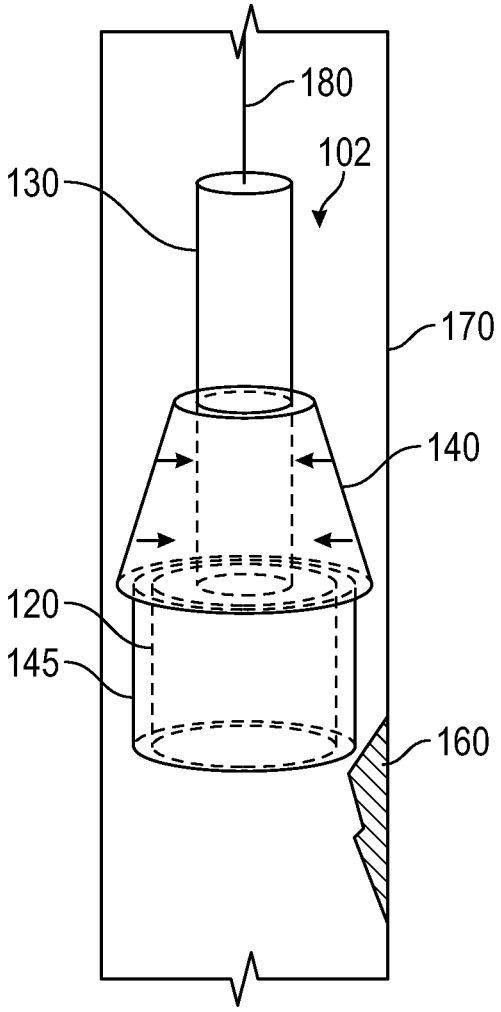
Figure 4C:
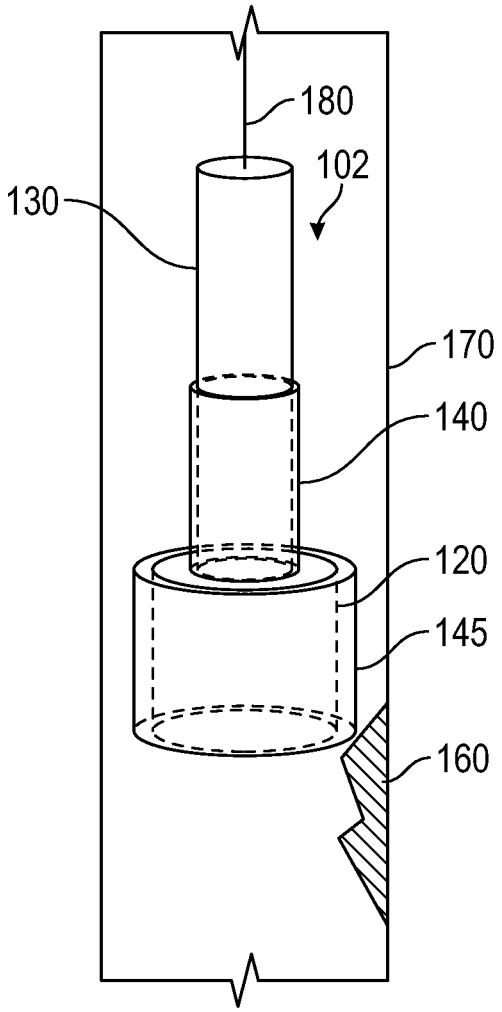

The third position includes the inner sleeve 145 concentrically disposed around the second cylindrical rod 120 as shown in FIGS. 4A to 4C. The fourth position includes the inner sleeve 145 concentrically disposed around the first cylindrical rod 130 after an interaction between the outer sleeve 140 and the obstruction 160 as shown in FIGS. 4E and 4F.

In the third position, the inner sleeve 145 is stretched to encircle the second cylindrical rod 120, and the outer sleeve 140 is stretched to encircle the inner sleeve 145, as shown in FIG. 4A. The stretched outer sleeves 140 remains connected to its underlay, the inner sleeve 145, and the inner sleeve 145 remains connected to its underlay, the second cylindrical rod 120, unless disturbed by an external force.

When the outer sleeves 140 collides with the obstruction 160, a force of the impact created by the interaction breaks the attachment of the outer sleeve 140 to the inner sleeve 145, and the outer sleeve 140 is pushed away from the inner sleeve 145.

FIG. 4B shows a transient configuration of the apparatus 110 according to one or more embodiments. FIG. 4B shows the contraction and shifting of the outer sleeve 140 after the collision with the obstruction 160. The force of impact from the interaction between the outer sleeve 140 and the obstruction 160 causes disconnection of the outer sleeve 140 from the inner sleeve 145. Depending on the shape and size of the obstruction 160, the inner sleeve 145 may not be affected by the obstruction 160 until the apparatus 110 moves further down the tubular 170, as shown in FIGS. 4A to 4F. In other embodiments, the inner sleeve 145 and the outer sleeve 140 may be affected by the obstruction 160 simultaneously.

Accordingly, the outer sleeve 140 moves away from the obstruction 160 due to the force of the impact from the collision. Simultaneously, the outer sleeve 140 starts shrinking after the attachment to the inner sleeve 145 is lost. Thus, the released portion of the outer sleeve 140 (the upper portion of the outer sleeve 140 in FIG. 4B) shrinks first, creating a truncated cone shape.

FIG. 4C shows a transition of the outer sleeve 140 from the first position after the collision with the obstruction 160. In the second position, the outer sleeve 140 encircles the first cylindrical rod 130 after receiving the force of impact, in the form of kinetic energy. When stretchable materials are used in the outer sleeve 140, the stored elastic potential energy may be utilized to propel the movement.

Figure 4D:
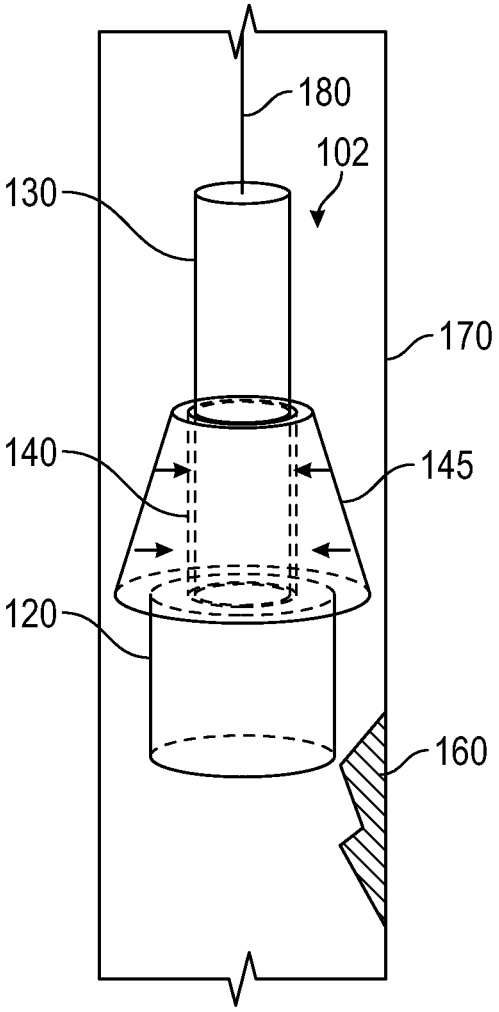
Figure 4E:
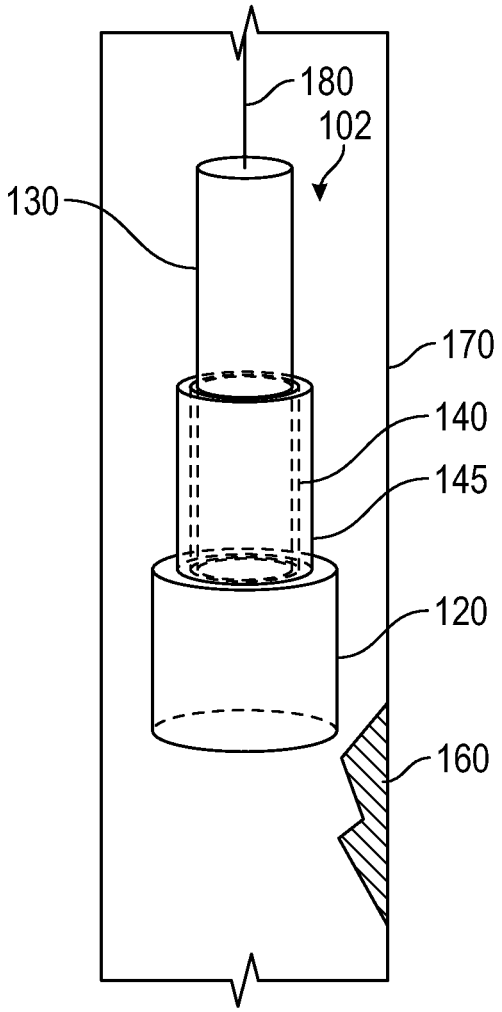
Figure 4F:
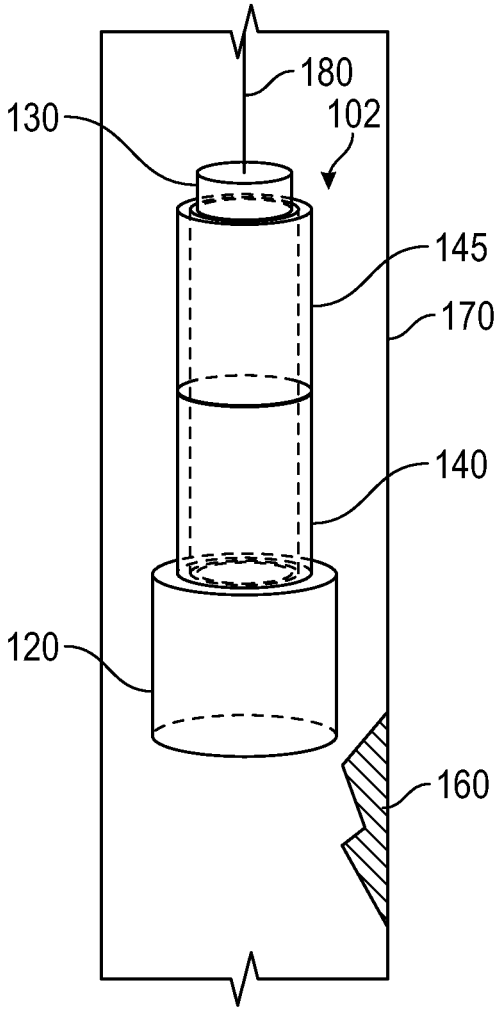

FIG. 4D shows a transient configuration of the apparatus 110 according to one or more embodiments. FIG. 4D shows the advancement of the apparatus 110 after the inner sleeve 145 interacts with the obstruction 160. That is FIG. 4D shows the inner sleeve 145 moving between the third position and the fourth position. In accordance with one or more embodiments, when the inner sleeve 145 collides with the obstruction 160, a force of the impact created by the interaction breaks the attachment of the inner sleeve 145 to the second cylindrical rod 120. Accordingly, the inner sleeve 145 is pushed away from the second cylindrical rod 120.

The inner sleeve 145 moves away from the obstruction 160 due to the force of the impact from the collision. At the same time, the inner sleeve 145 starts contracting once the inner sleeve 145 is allowed to contract around a smaller object, i.e., the first cylindrical rod 130. In accordance with one or more embodiments, the released portion of the inner sleeve 145 (the upper portion in FIG. 4B) contracts first creating a truncated cone shape.

FIG. 4E shows another configuration of the apparatus 110 after the interaction with the obstruction in accordance with one or more embodiments. The configuration shown in FIG. 4E presents a transient or a final position of the inner sleeve 145, depending on the degree of the shifting of the inner sleeve 145 from the second cylindrical rod 120. If the force of the impact from the collision does not provide enough energy to the inner sleeve 145 to move past the outer sleeve 140 in the second position, then the inner sleeve 145 stops moving. In this scenario, the inner sleeve 145 is disposed concentrically around the outer sleeve 140 and the first cylindrical rod 130.

In other embodiments, the inner sleeve 145 may continue shifting away from the second cylindrical rod 120, if there is ample force applied to the inner sleeve 145 from the collision. As such, the inner sleeve 145 may move past the outer sleeve 140, located in the second position, after the interaction with the obstruction 160.

FIG. 4F shows the configuration of the apparatus 110, if the force of the impact pushes the inner sleeve 145 past the outer sleeve 140 located in the second position. In this scenario, the inner sleeve 145 may only be disposed concentrically around the first cylindrical rod 130.

As described previously, the system 100 may detect the presence and/or approximate location of the obstruction 160 using various methods. In addition, the system 100 may estimate the size of the obstruction 160 by identifying the number of shifted sleeves. The size of the obstruction 160 determines how many sleeves collide with the obstruction 160 and move from the second cylindrical rod 120 to the first cylindrical rod 130.

Figure 5A:
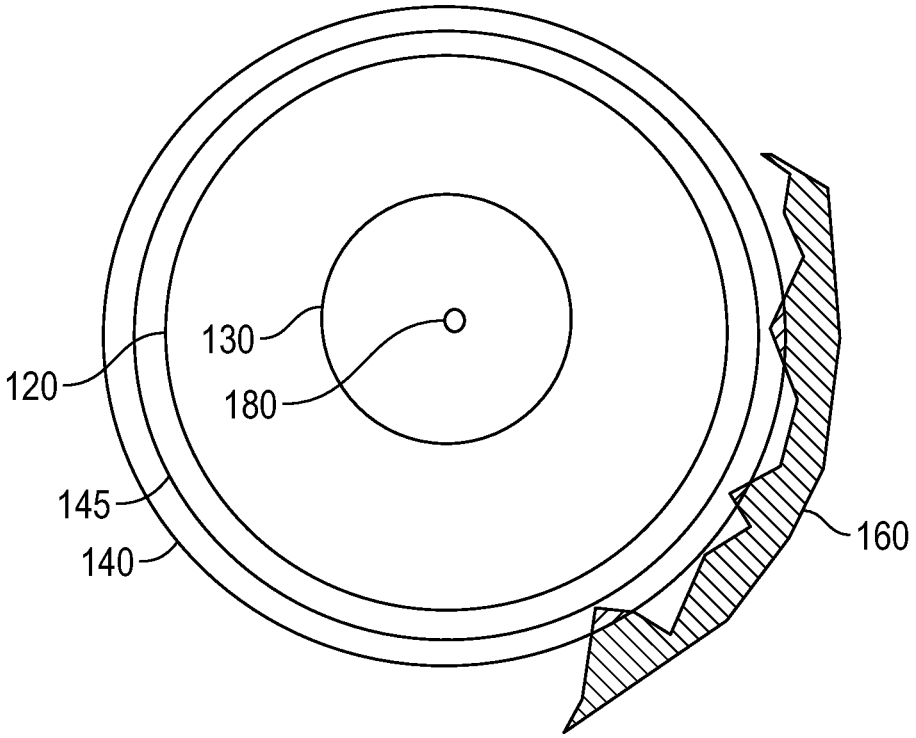
FIGS. 5A and 5B show top views of an apparatus in accordance with one or more embodiments.
Figure 5B:
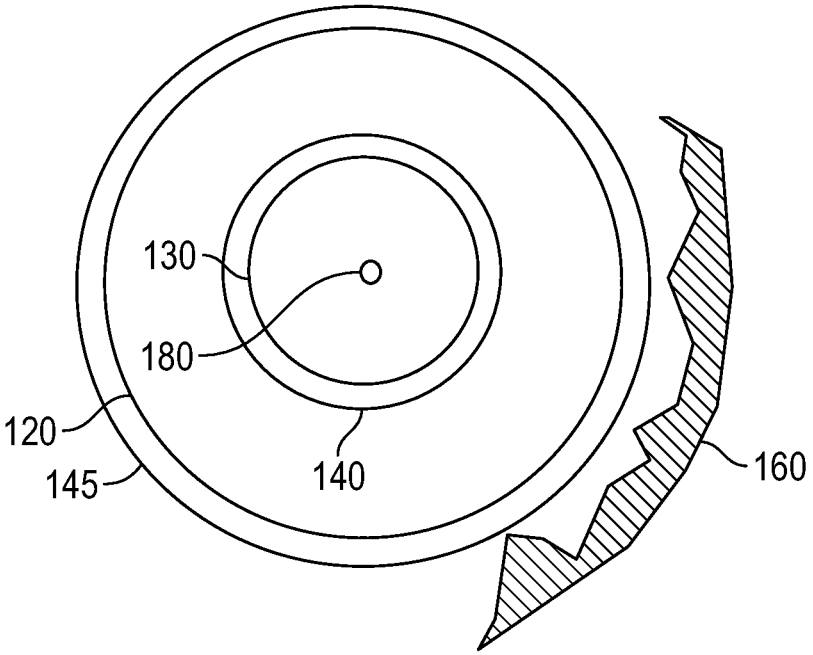

The sequence of events discussed in detail in relation to FIGS. 3A to 3D is shown in top views of the apparatus 110, depicted in FIGS. 5A and 5B in accordance with one or more embodiments.

FIG. 5A illustrates the configuration of the apparatus 110 before the collision with the obstruction 160. The apparatus 110 includes the outer sleeve 140 and the inner sleeve 145 disposed around the second cylindrical rod 120. As is clear from FIG. 5A, the obstruction 160 is sized such that the obstruction 160 does not reach the outer surface of the inner sleeve 145. However, the obstruction 160 does extend to the outer surface of the outer sleeve 140. Accordingly, the collision with the obstruction 160 impacts only the outer sleeve 140.

As a result, the outer sleeve 140 is released from the inner sleeve 145 and shifts away from the second cylindrical rod 120. The outer sleeve 140 shifts and contracts to be disposed around the first cylindrical rod 130 in accordance with one or more embodiments. As shown in FIG. 5B, the diameter of the apparatus 110 decreases by the thickness of the shifted outer sleeve 140.

The sequence of events discussed in detail in relation to FIGS. 4A to 4F is summarized in top views of the apparatus 110, as depicted in FIGS. 6A to 6D in accordance with one or more embodiments.

Figure 6A:
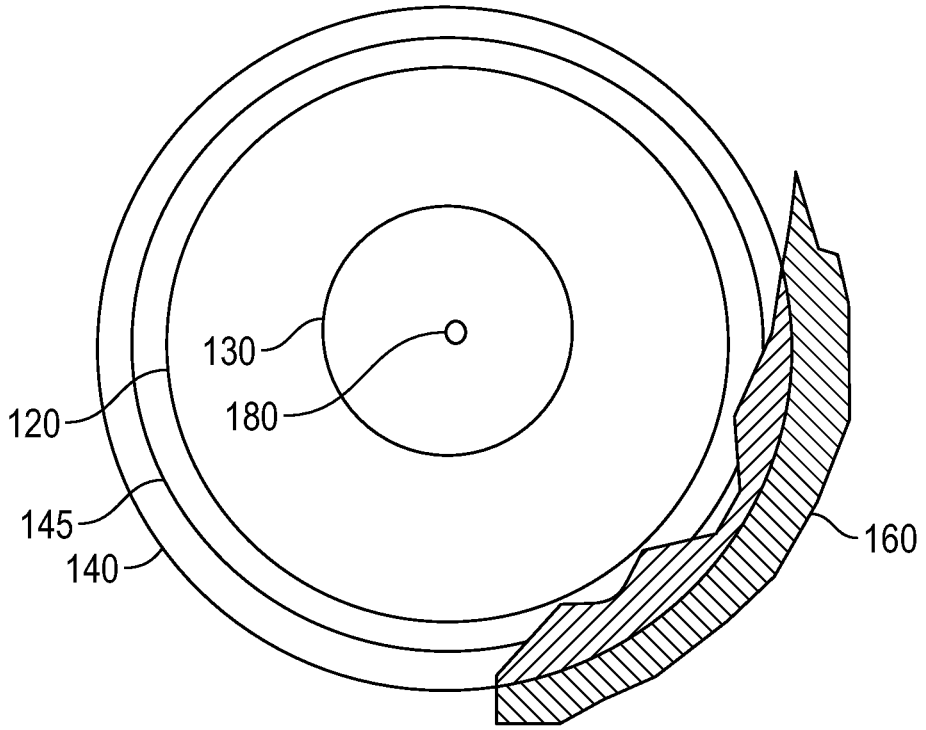
FIGS. 6A to 6D show top views of an apparatus in accordance with one or more embodiments.

FIG. 6A illustrates the configuration of the apparatus 110 before the collision with the obstruction 160. The apparatus 110 includes the outer sleeve 140 and the inner sleeve 145 disposed around the second cylindrical rod 120. The obstruction 160 is sized such that the obstruction 160 extends to both the outer surface of the inner sleeve 145 and the outer surface of the outer sleeve 140.

Figure 6B:
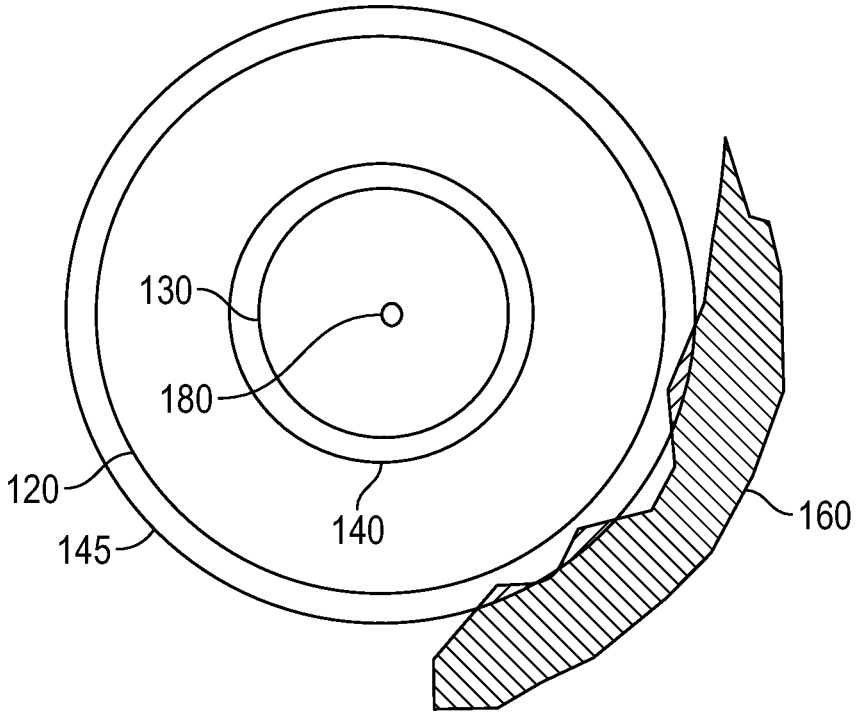

Accordingly, the obstruction 160 collides with the outer sleeve 140, resulting in the displacement of the outer sleeve 140, as shown in FIG. 6B. The outer sleeve 140 is released from the inner sleeve 145 and moves away from the second cylindrical rod 120. The outer sleeve 140 shifts and contracts to be disposed around the first cylindrical rod 130 in accordance with one or more embodiments.

Figure 6C:
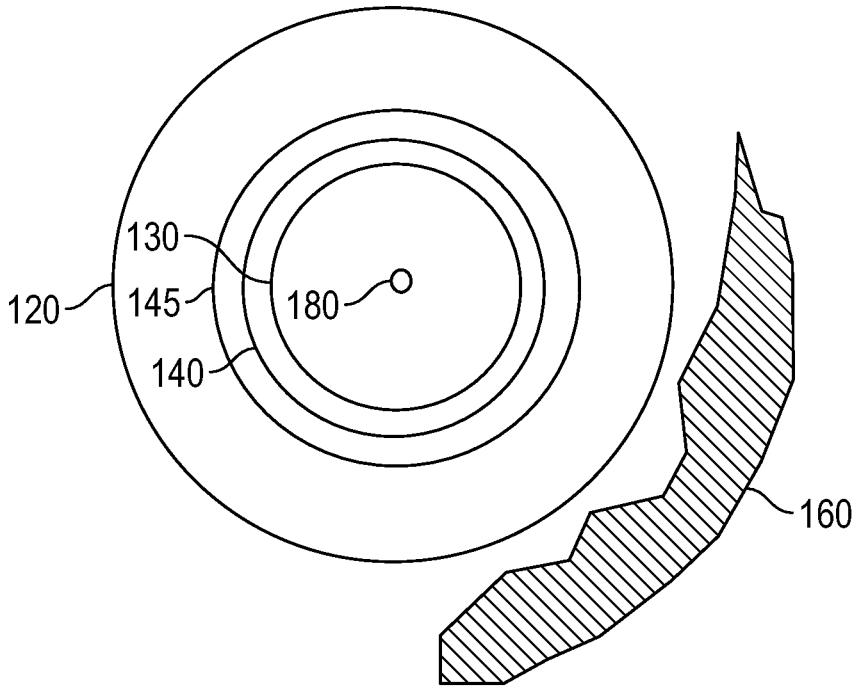

In accordance with one or more embodiments, the obstruction 160 also hits the inner sleeve 145. The inner sleeve 145 receives the force of the impact. The force of impact releases the inner sleeve 145 from the second cylindrical rod 120. The force of impact also causes the inner sleeve 145 to move away from the second cylindrical rod 120, as shown in FIG. 6C. The inner sleeve 145 shifts and contracts to be disposed around the outer sleeve 140. Based on the size of the force of impact, the inner sleeve 145 may stay disposed around the outer sleeve 140 or the inner sleeve 145 may shift further to be disposed directly around the first cylindrical rod 130.

Figure 6D:
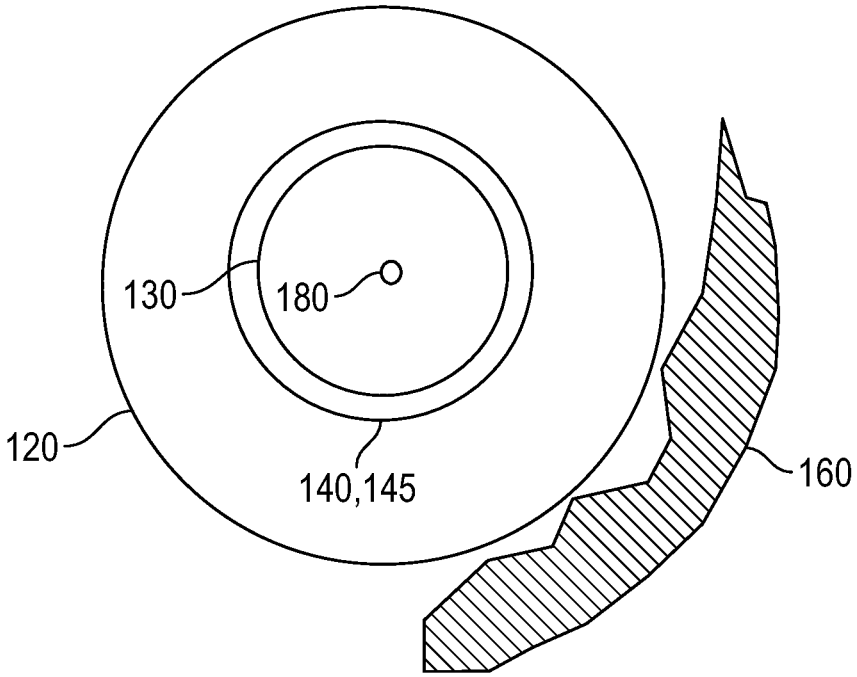

As is clear from FIG. 6D, the size of the apparatus 110 decreases by the thickness of the shifted outer sleeve 140 and inner sleeve 145.

Figure 7:
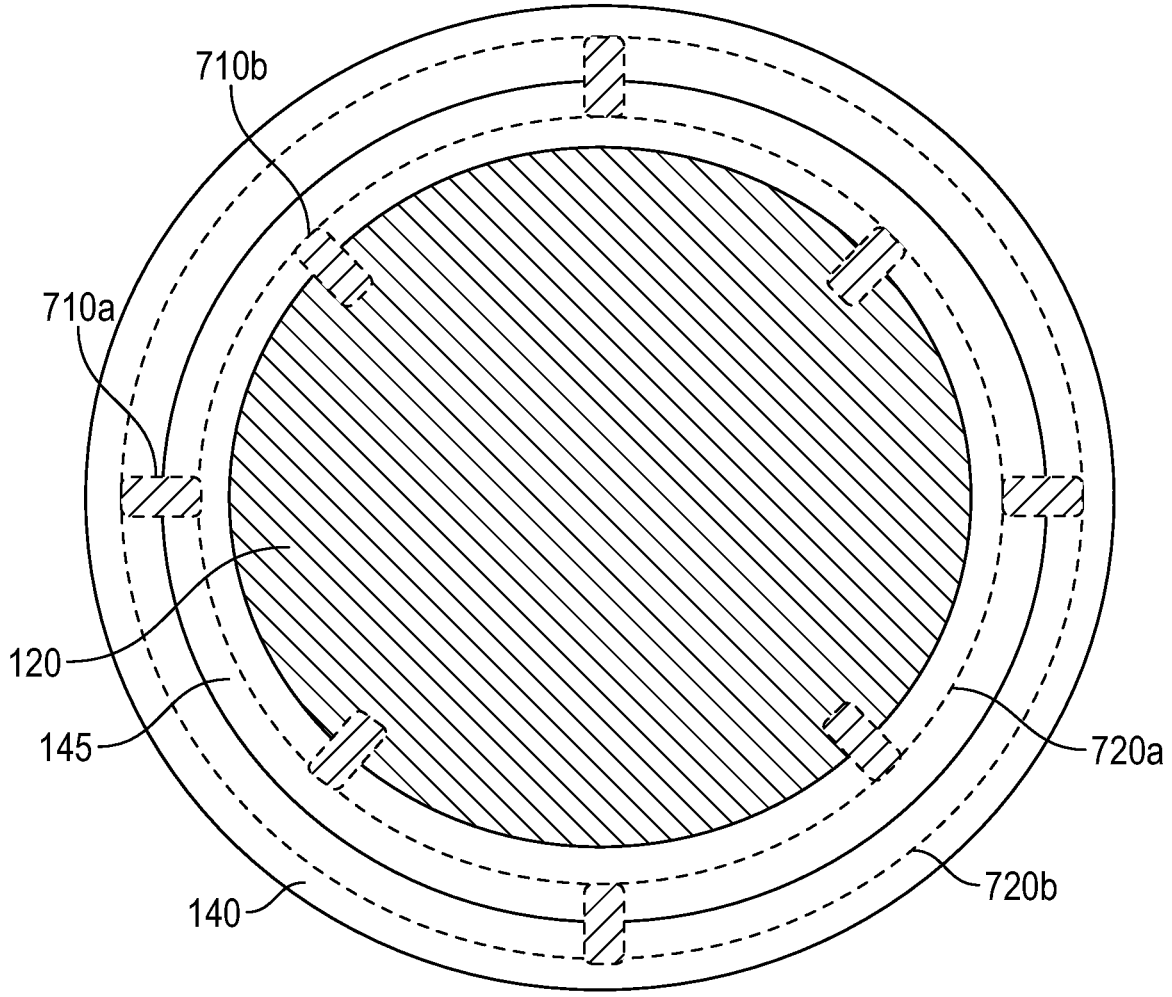
FIG. 7 shows a horizontal cross-section view of an apparatus in accordance with one or more embodiments.

FIG. 7 shows a horizontal cross-section view of the apparatus 110 before the collision with the obstruction 160 in accordance with one or more embodiments. FIG. 7 depicts the arrangement of the apparatus 110 dissected at the level of L-L' in FIG. 2. The apparatus 110 incorporates stretchable elements 720 as indicated by dashed lines. At least one stretchable element 720 is embedded in the inner sleeve 145, and at least one stretchable element 720 is embedded in the outer sleeve 140. In accordance with one or more embodiments, the stretchable elements 720 shown in FIG. 7 may be embedded coils/springs or elastic bands.

In accordance with one or more embodiments, the outer sleeve 140 and the inner sleeve 145 are connected to one another by one or more pins 710*a*. In further embodiments, the inner sleeve 145 is connected to the second cylindrical rod 120 by one or more pins 710*b*. The pins 710*a*, 710*b* may be shear pins 710*a*, 710*b* that are designed to break, or shear, when a predetermined pressure is seen across the pins 710*a*, 710*b*. The predetermined pressure may be applied by the interaction between the apparatus 110 and the obstruction 160. In addition to, or in alternative to the plurality of pins 710*a*, 710*b*, other types of instruments that have the ability to break off may be used for the connection of the outer sleeve 140 to the inner sleeve 145 and the connection of the inner sleeve 145 to the second cylindrical rod 120.

FIGS. 8A to 8D show schematic views of a stretchable cylindrical sleeve in accordance with one or more embodiments. The sleeve shown in FIGS. 8A to 8D may be the inner sleeve 145 or the outer sleeve 140 as outlined above. The sleeve shown in FIGS. 8A to 8D is shown not installed as part of the apparatus 110.

FIGS. 8A to 8D further show the sleeve having a plurality of cutters 810*a*-810*e*. In accordance with one or more embodiments, the cutters 810*a*-810*e* are a sharp edge on an end of the sleeve. The cutters 810*a*-810*e* may be located on the downhole end of the sleeve when the sleeve is installed as part of the apparatus 110 and deployed in the well 104. In one example and as shown in FIGS. 8A to 8D, the sleeve is comprised of a plurality of panels 830*a*-830*e* that are connected to one another by stretchable elements 720.

FIGS. 8A to 8D show two different configurations of stretchable elements 720; however, these configurations are not meant to be limiting and the sleeve may have any type and any configuration of stretchable elements without departing from the scope of the disclosure herein.

Figure 8A:
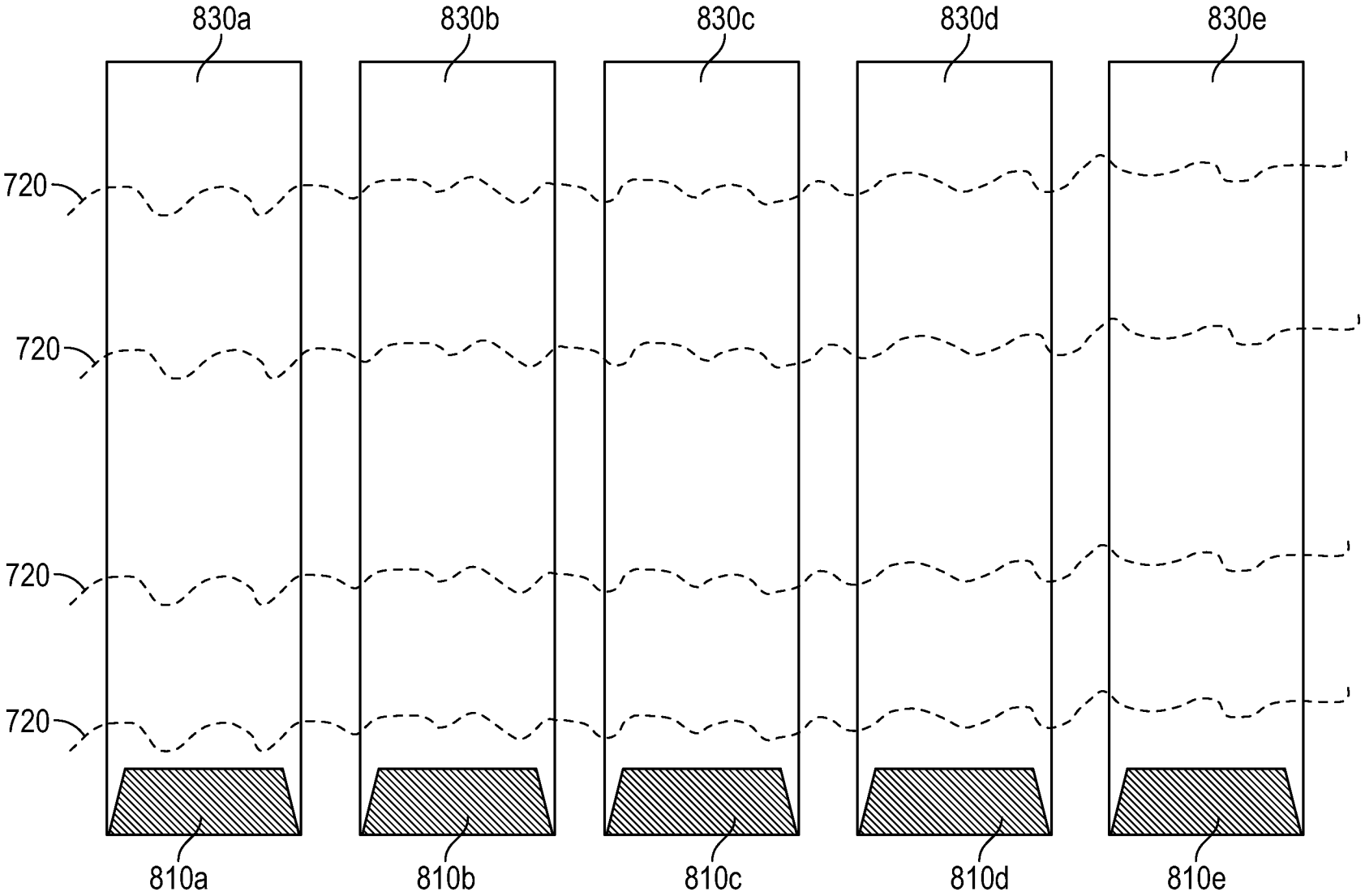
FIGS. 8A to 8D show schematic views of a cylindrical sleeve in accordance with one or more embodiments.
Figure 8B:
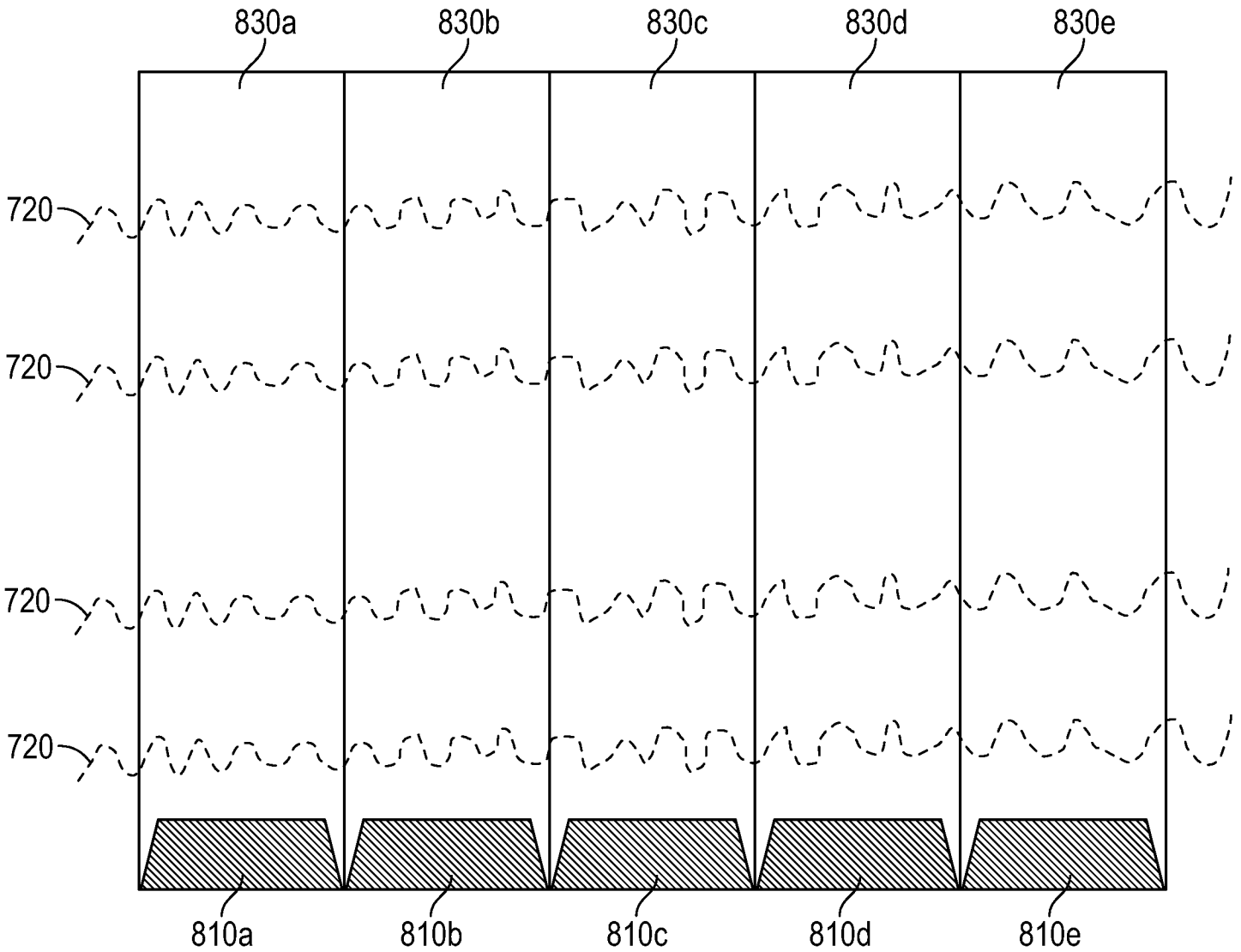
Figure 8C:
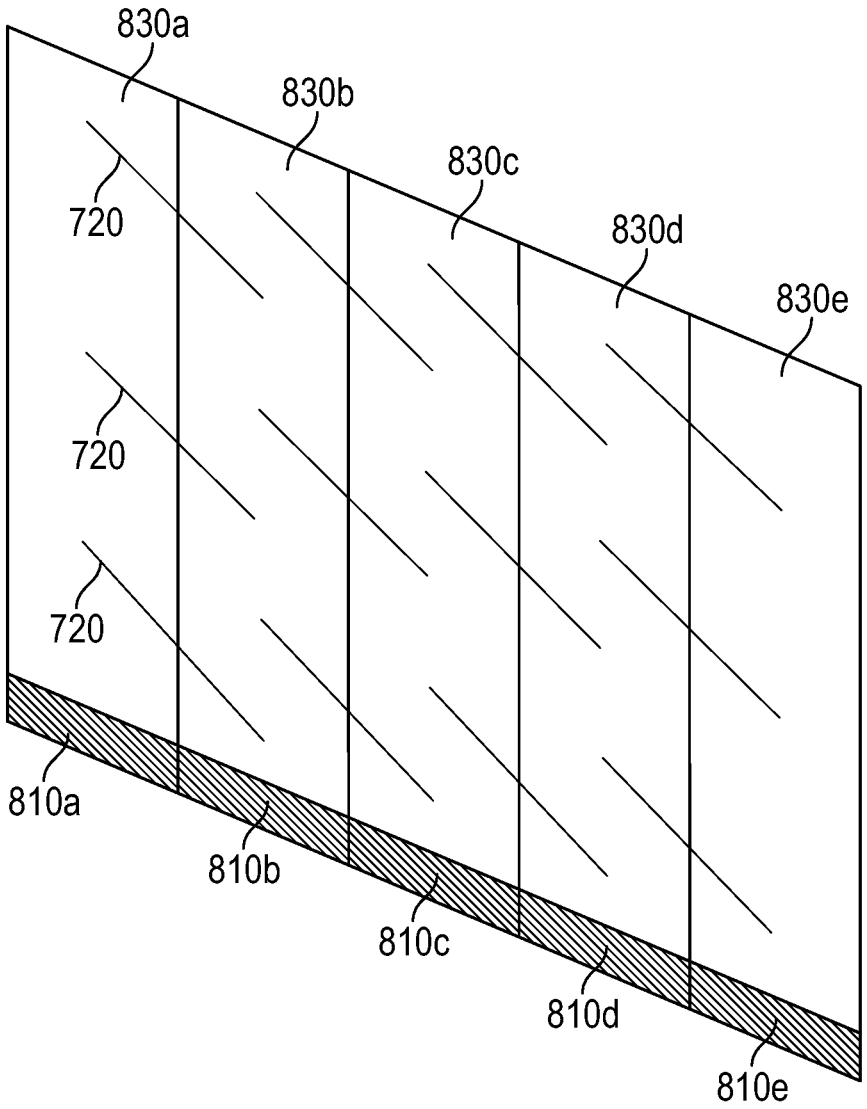

The stretchable elements 720 shown in FIGS. 8A and 8B are stretchable elements 720 that extend through all five panels. The stretchable elements 720 shown in FIGS. 8C and 8D are diagonally aligned stretchable elements 720. Each diagonally aligned stretchable element only connects two neighboring panels 830*a*-830*e* rather than extending across all five panels 830*a*-830*e*.

FIG. 8A shows the sleeve in a state where an external force to stretch the sleeve is applied. In accordance with one or more embodiments, the extended sleeve may have a sufficient circumference to be disposed around the second cylindrical rod 120. The panels 830*a*-830*e* may be made of metal or other durable materials, and each panel 830*a*-830*e* may lack foldable parts. In such implementations, each panel 830*a*-830*e* is separated from neighboring panels when stretched, as shown in this example. However, the panels 830*a*-830*e* may include extendable pleated sheets, which provide connections to neighboring panels even in a stretched position.

FIG. 8B shows the sleeve, as described in FIG. 8A, in a baseline state where an external force to stretch the sleeve is not applied in accordance with one or more embodiments. The stretchable element 720 are shown in a relaxed state. In the relaxed state, the stretchable elements 720 and hold the panels 830*a*-830*e* closer to one another when compared to the stretchable elements 720 being in the stretched state shown in FIG. 8A. In accordance with one or more embodiments, the stretchable elements 720 may be in the relaxed state when the attachment to an underlay (e.g., pins 710*a*, 710*b*) is broken.

Turning to FIG. 8C, the stretchable elements 720 shown are diagonally aligned stretchable elements 720. Each diagonally aligned stretchable element 720 connects two neighboring panels 830*a*-830*e*. In accordance with one or more embodiments, the circumference of the sleeve lengthens if an external force stretches the stretchable elements 720. As a result, the sleeve may be disposed around the second cylindrical rod 120. FIG. 8C shows the sleeve in an extended or stretched state. Because the stretchable elements 720 run diagonally in relation to each panel 830*a*-830*e*, each panel 830*a*-830*e* may be touching its neighboring panels 830*a*-830*e* when in the stretched position.

Figure 8D:
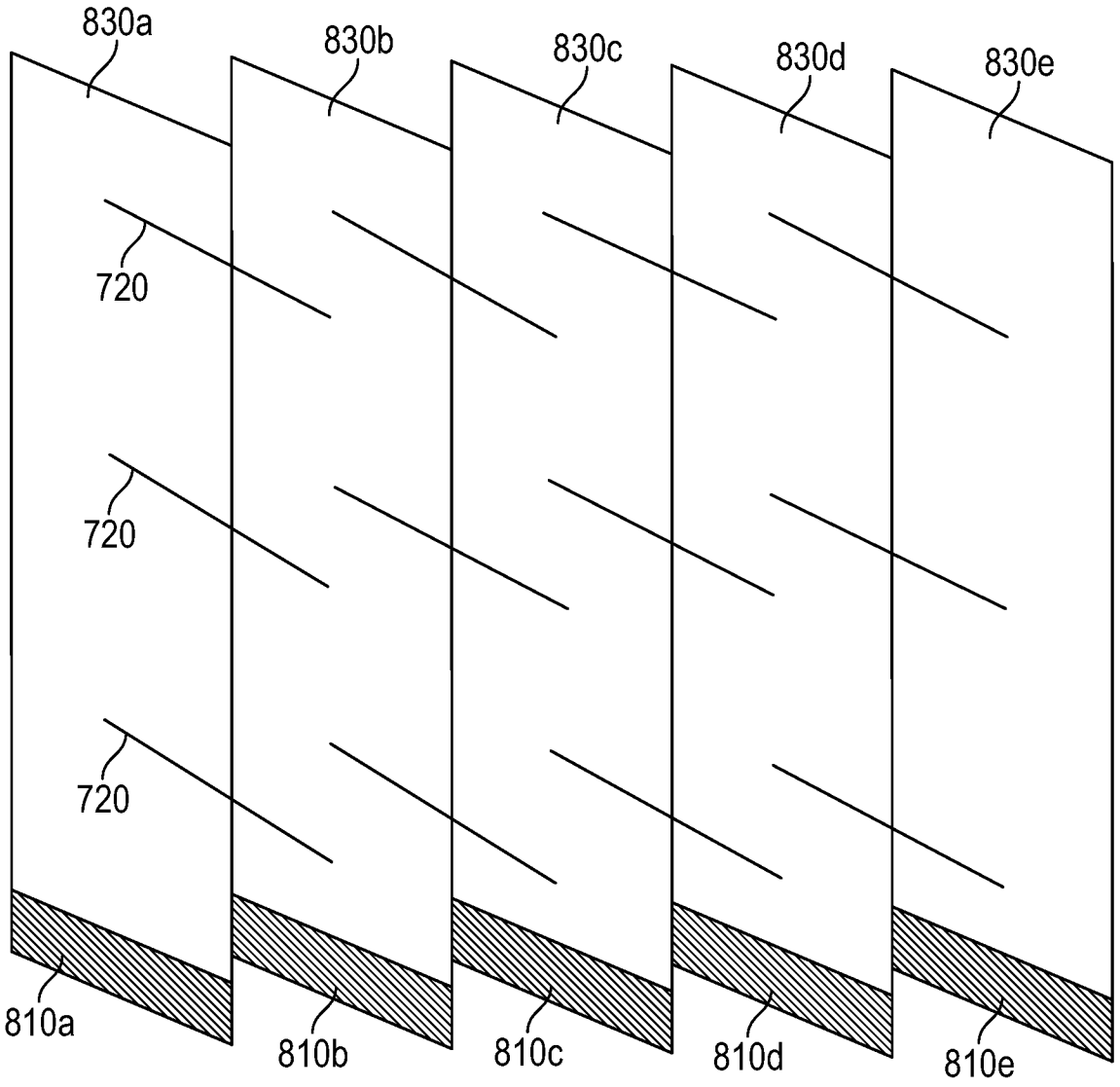

FIG. 8D shows the sleeve in a baseline state where an external force to stretch the sleeve is not applied in accordance with one or more embodiments. In further embodiments, the stretchable elements 720 revert to a relaxed position, causing the panels 830*a*-830*e* to move closer to one another, when the attachment to an underlay (e.g., pins 710*a*, 710*b*) is broken.

In accordance with one or more embodiments, the second cylindrical rod (120) outlined above may be a sand bailer 900 and the first cylindrical rod (130) outlined above may be a fish neck 902. The fish neck 902 may be machined as part of the sand bailer 900 or may be a separate component connected to the sand bailer 900 without departing from the scope of the disclosure herein. The sand bailer 900 may be used to obtain a sample 1100 of the obstruction 160. Similar to the first cylindrical rod (130) and second cylindrical rod (120) relationship, the fish neck 902 has a smaller outer diameter than the rest of the sand bailer 900.

Figure 9:
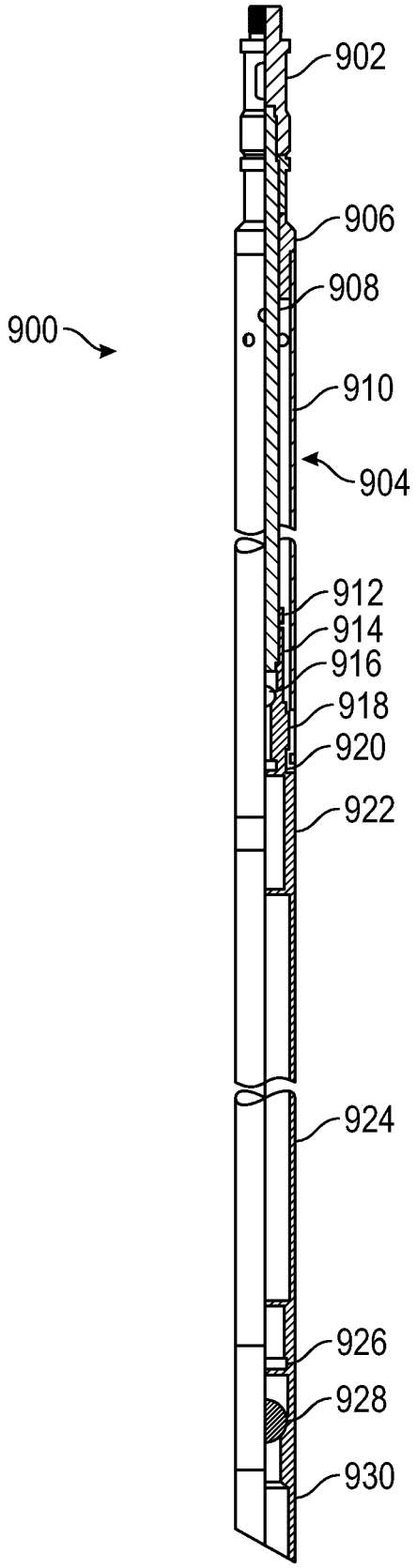
FIG. 9 shows a sand bailer with a fish neck in accordance with one or more embodiments.
Figure 10:
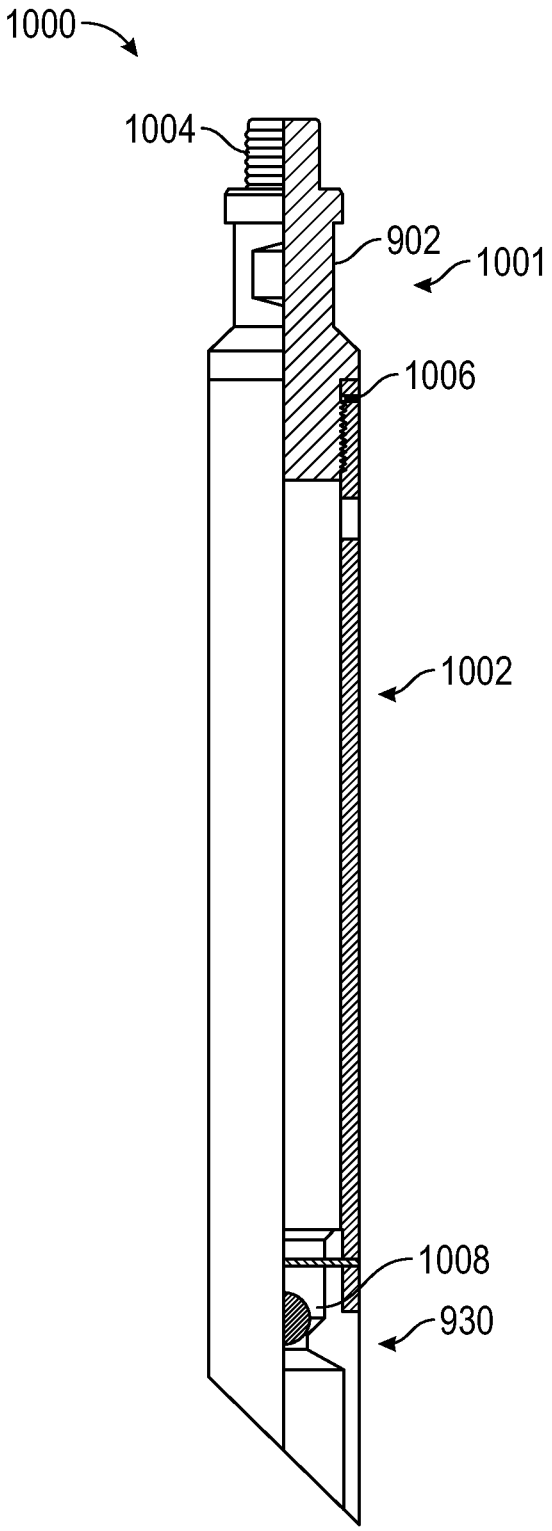
FIG. 10 shows a sand bailer with a fish neck in accordance with one or more embodiments.

Accordingly, FIGS. 9 and 10 show a sand bailer 900, 1000 with a fish neck 902 in accordance with one or more embodiments. Specifically, FIGS. 9 and 10 show two configurations of a sand bailer 900, 1000 and a fish neck 902. A person skilled in the art will appreciate that the sand bailers 9000, 1000 shown in FIGS. 9 and 10 are shown for example purposes and any type of sand bailer having any type of configuration may be used without departing from the scope of the disclosure herein.

Turning to FIG. 9, the sand bailer 900 is a pump action type bailer that is designed to remove sand and debris (e.g., the obstruction 160) from the tubular 170 through an upward stroking motion of a pump section 904. When the upward stroking motion is performed, a suction pressure is created inside a load barrel 924 of the sand bailer 900. This suction pressure causes an influx of adjacent wellbore fluid and sand/debris to flow into the load barrel 924. The upward stroking motion may be initiated by setting down the sand bailer 900 on the obstruction 160 or by sending an electronic or hydraulic signal along the deployment device 180 without departing from the scope of the disclosure herein.

A ball valve having a lower ball 928 in a ball housing 926 prevents the captured wellbore fluid and sand/debris from falling out the shoe 930 of the sand bailer 900. In other embodiments, a one way check valve may be used in place of the ball valve to allow the fluid/sand/debris to flow up hole into the load barrel 924, when the suction pressure is created, and prevent the fluid/sand/debris from flowing downhole out of the load barrel 924.

In accordance with one or more embodiments, the load barrel 924 is connected to the pump section 904 through a crossover 922 that is designed to mate the two components. The pump section 904 itself may be made of a piston stop 906, a stroke rod 908, a barrel 924, a stop ring 912, a piston 914, an upper ball 916, wobble washers 918, and a piston nut 920.

The piston stop 906 and the stop ring 912 are the upper and lower, respectively, stoke locations of the piston 914 inside of the barrel 924. That is, the piston 914 may begin at the stop ring 912 and stroke in an upward direction to the piston stop 906. This upward stroke motion causes a suction pressure in the load barrel located downhole from the piston 914.

Turning to FIG. 10, the sand bailer 1000 may have an alternative configuration to the one shown in FIG. 9 without departing from the scope of the disclosure herein. Specifically, the sand bailer 1000 may comprise a top sub 1001, a bailer tube 1002, and a shoe 930. The top sub 1001 may include the fish neck 902 and a tool connection 1004. In accordance with one or more embodiments, the tool connection 1004 is used to connect the sand bailer 1000 to the deployment device 180.

The bailer tube 1002 may be of varying lengths depending on the requirements of the operation. In accordance with one or more embodiments, the bailer tube 1002 may be similar to the load barrel 924 of FIG. 9. In other embodiments, the bailer tube 1002 may include a pressure relief hole 1006 at the up hole portion of the bailer tube 1002 The pressure relief hole 1006 may be used to equalize pressure when a flapper or ball valve 1008 in the shoe 930 opens the bailer tube 1002 to the downhole environment to allow the fluid/sand/debris to flow up hole into the bailer tube 1002.

The shoe 930 may include a flapper or ball check valve to allow the fluid/sand/debris to flow up hole into the bailer tube 1002 yet prevent the fluid/sand/debris to fall out of the bailer tube 1002 once inside. FIG. 10 specifically shows a ball valve 1008. The ball valve 1008 may act similar to the lower ball 928 and ball housing 926 of FIG. 9.

FIGS. 11*a*-11*f* show a cross section of an operational sequence of the apparatus 110 when the second cylindrical rod 120 is the sand bailer 900 and the first cylindrical rod 130 is the fish neck 902 in accordance with one or more embodiments. FIGS. 11*a*-11*f* show the sand bailer 900 of FIG. 9, however any configuration of a sand bailer, such as the configuration shown in FIG. 10, may be used without departing from the scope of the disclosure herein. The apparatus 110 is shown deployed in a tubular 170 having an obstruction 160. Components shown in FIGS. 11*a*-11*f* that have been introduced in FIGS. 1-9 have not been redescribed for purposes of readability and have the same description and function as outlined above.

Figure 11C:
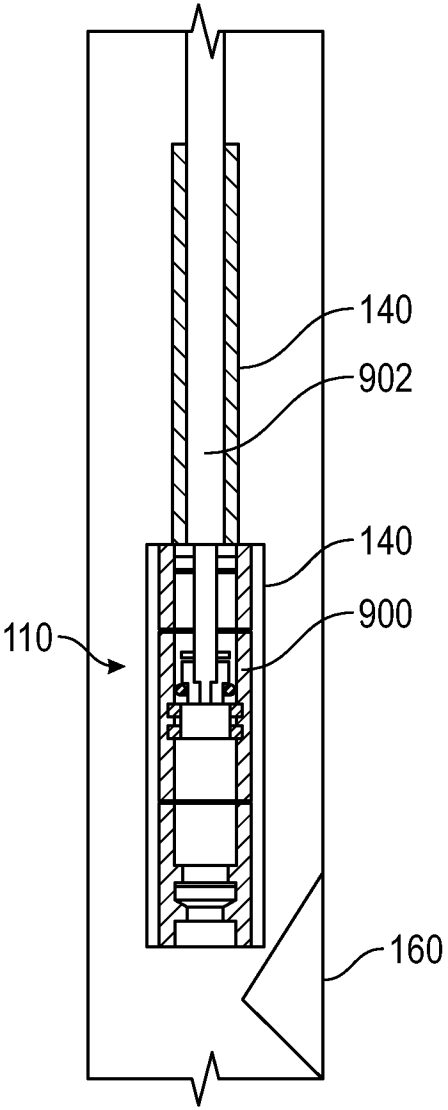
FIGS. 11*a*-11*f* show a cross section of an operational sequence of the apparatus when the second cylindrical rod is the sand bailer and the first cylindrical rod is the fish neck in accordance with one or more embodiments.
Figure 11B:
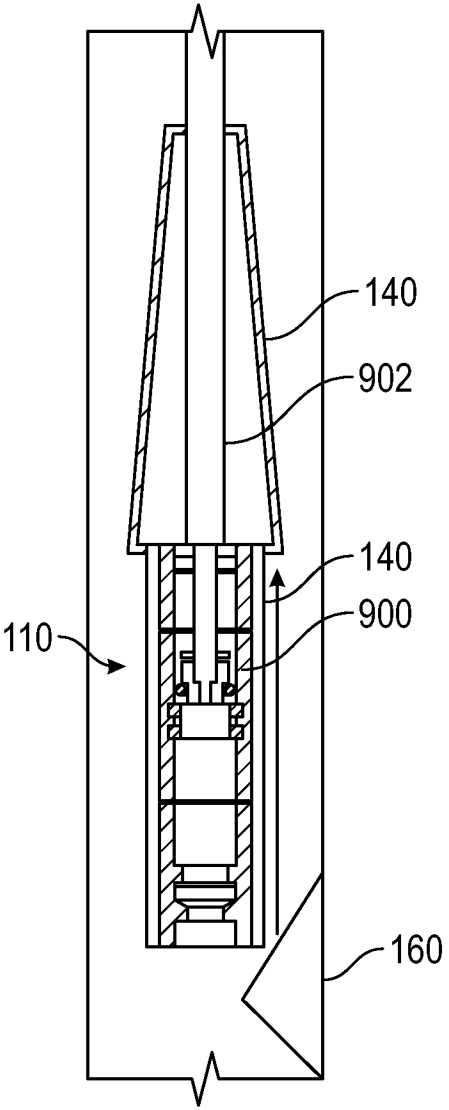
Figure 11A:
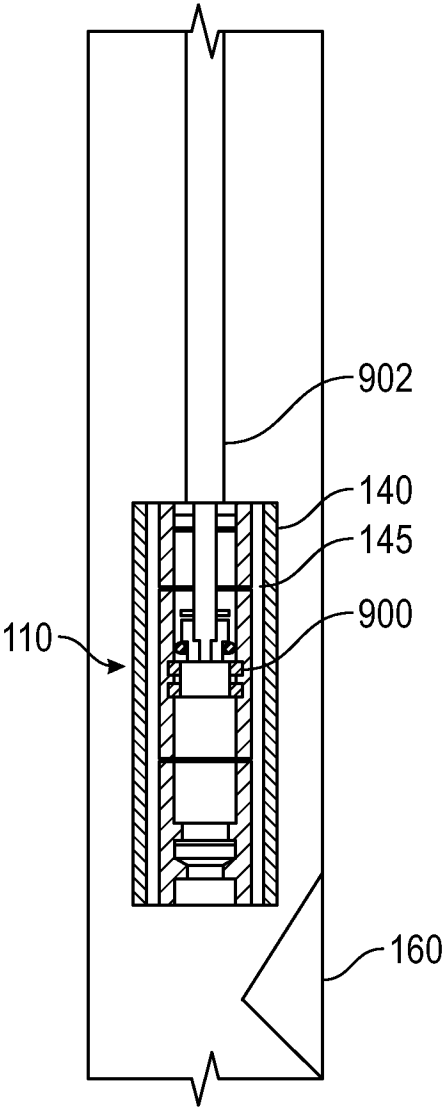

In FIG. 11*a*, the apparatus 110 is shown with the inner sleeve 145 wrapped around the sand bailer 900 and the outer sleeve 140 wrapped around the inner sleeve 145. In accordance with one or more embodiments, the inner sleeve 145 is removably connected to the sand bailer 900 via one or more pins 710*a*, 710*b* and the outer sleeve 140 is removably connected to the inner sleeve 145 via one or more pins 710*a*, 710*b*.

FIG. 11*a* shows the apparatus 110 approaching the obstruction 160. FIG. 11*b* shows the outer sleeve 140 hitting the obstruction 160. When the outer sleeve hits the obstruction 160, the pins 710*a*, 710*b* shear and the force of the interaction pushes the outer sleeve 140 in an upward direction towards the fish neck 902. Due to the make-up of the outer sleeve 140, as outlined in FIGS. 8*a*-8*d*, the outer sleeve 140 shrinks to the size of the fish neck 902. FIG. 11*c* shows the outer sleeve 140 having shrunk in size and wrapped around the fish neck 902.

Figure 11F:
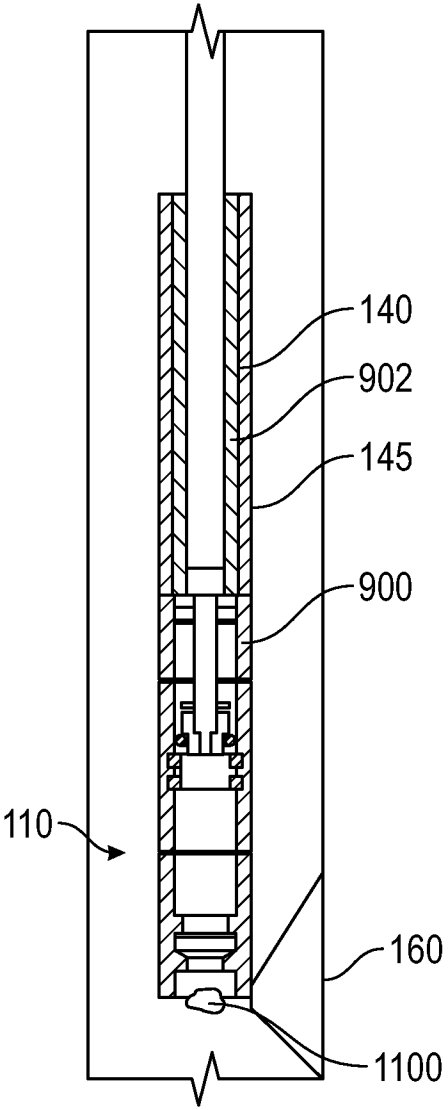
Figure 11E:
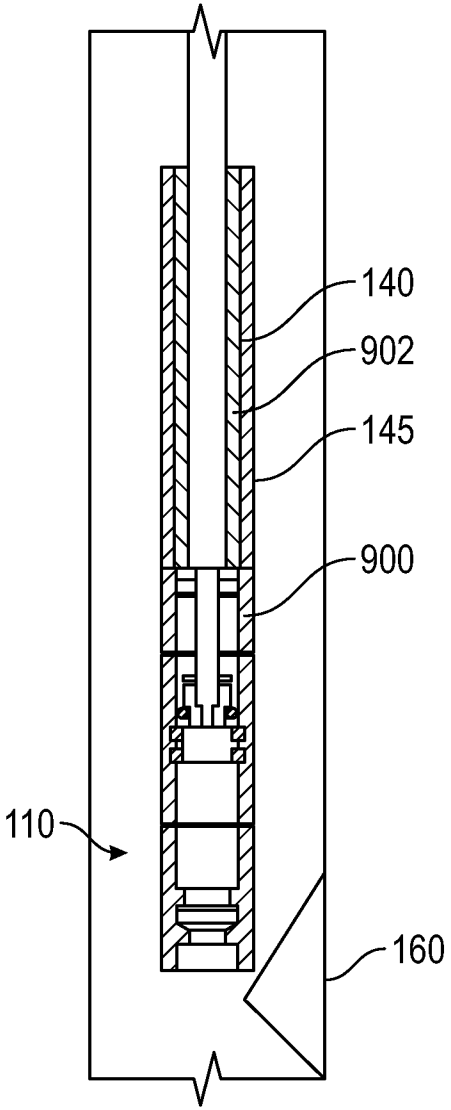
Figure 11D:
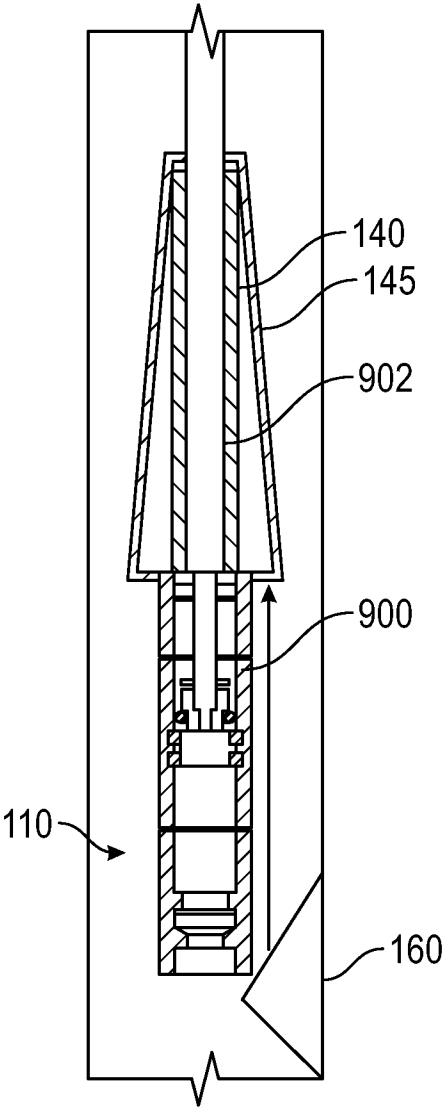

In FIG. 11*d*, the apparatus 110 is lowered further, and the inner sleeve 145 hits the obstruction 160. When the inner sleeve 145 hits the obstruction 160, the pins 710*a*, 710*b* shear and the force of the interaction pushes the inner sleeve 145 in an upward direction towards the fish neck 902. Due to the make-up of the inner sleeve 145, as outlined in FIGS. 8a-8d, the inner sleeve 145 shrinks to the size of the outer sleeve 140 wrapped around the fish neck 902. FIG. 11e shows the inner sleeve 145 having shrunk in size and wrapped around the outer sleeve 140 wrapped around the fish neck 902.

In FIG. 11f, the apparatus 110 has been lowered further into the tubular 170 and the sand bailer 900 has hit the obstruction 160. When the sand bailer 900 hits the obstruction 160, the pump section 904 may be activated, by either setting down the sand bailer 900 on the obstruction 160 or sending a signal to the pump section 904 via the deployment device 180. When the pump section 904 is activated, a suction pressure is created in the load barrel 924 and a sample 1100 of the obstruction 160 is sucked into the load barrel 924. At this point, the apparatus 110 may be removed from the tubular 170 and the sample 1100 of the obstruction 160 may be analyzed.

In other embodiments not pictured, the obstruction 160 may not be large enough to activate the sand bailer 900 and the apparatus 110 may be used to determine the drift size of the tubular 170 based on the number of sleeves removed from the sand bailer 900.

Figure 12:
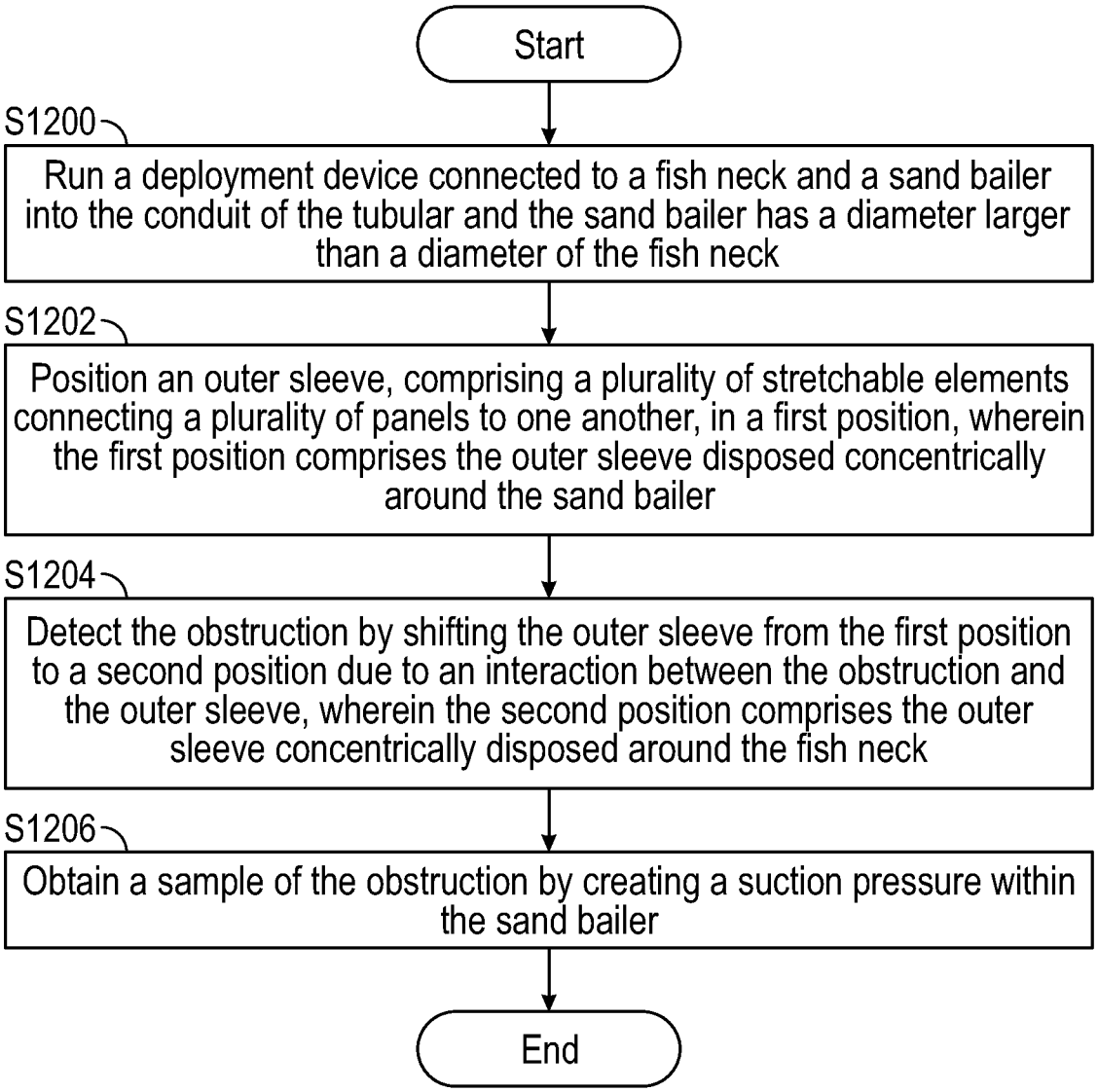
FIG. 12 shows a flowchart in accordance with one or more embodiments.

FIG. 12 shows a flowchart in accordance with one or more embodiments. The flowchart outlines a method for detecting an obstruction 160 and obtaining a sample of the obstruction 160 in a conduit 102 of a tubular 170. While the various blocks in FIG. 12 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S1200, a deployment device 180 connected to a fish neck 902 and a sand bailer 900, 1000 is run into the conduit 102 of the tubular 170. The sand bailer 900, 1000 has a diameter larger than a diameter of the fish neck 902. In accordance with one or more embodiments, one end of the fish neck 902 is connected to the deployment device 180 and the other end of the fish neck 902 is connected to the sand bailer 900, 1000.

In accordance with one or more embodiments, the deployment device 180 is wireline, slickline, or drill pipe. The tubular 170 may be disposed in a well 104. The tubular 170 may have an obstruction 160 that reduces the accessible inner diameter of the tubular 170. In further embodiments, the deployment device 180 is running the fish neck 902 and the sand bailer 900, 1000 through the conduit 102 of the tubular 170 to determine the accessible inner diameter of the tubular 170.

In S1202, an outer sleeve 140, comprising a plurality of stretchable elements 720 connecting a plurality of panels 830a-830e to one another, is positioned in a first position. The first position includes the outer sleeve 140 disposed concentrically around the sand bailer 900, 1000.

In accordance with one or more embodiments, an inner sleeve 145, comprising a plurality of stretchable elements 720 connecting a plurality of panels 830a-830e to one another, is positioned in a third position. The third position includes the inner sleeve 145 disposed concentrically around the sand bailer 900, 1000 between the outer sleeve 140 and the sand bailer 900.

In further embodiments, the inner sleeve 145 is movably connected to the sand bailer 900, 1000 using one or more pins 710a, 710b, and the outer sleeve 140 is movably connected to the inner sleeve 145 also using one or more pins 710a. 710b. The pins 710a. 710b may be shear pins 710a, 710b in accordance with one or more embodiments. Further, the stretchable elements 720 connecting the panels 830a-830e are used to change the diameter and circumference of the inner sleeve 145 and the outer sleeve 140 based on the size of the underlay.

In S1204, the obstruction 160 is detected by shifting the outer sleeve 140 from the first position to a second position due to an interaction between the obstruction 160 and the outer sleeve 140. The second position includes the outer sleeve 140 concentrically disposed around the fish neck 902.

In accordance with one or more embodiments, the obstruction 160 is also detected by shifting the inner sleeve 145 from the third position to a fourth position due to an interaction between the inner sleeve 145 and the obstruction 160. The fourth position includes the inner sleeve 145 concentrically disposed around the fish neck 902. In the fourth position, the inner sleeve 145 may be directly disposed around the fish neck 902, or the inner sleeve 145 may be disposed around the fish neck 902 and the outer sleeve 140.

In further embodiments, a size of the obstruction 160 is determined based on the outer sleeve 140 shifting from the first position to the second position. In other embodiments, the size of the obstruction 160 is determined based on the outer sleeve 140 shifting from the first position to the second position and the inner sleeve 145 being retained in the third position. Alternatively, the size of the obstruction 160 is determined based on the outer sleeve 140 shifting from the first position to the second position and the inner sleeve 145 shifting from the third position to the fourth position. In other words, the accessible inner diameter of the tubular 170 may be determined based on the number of sleeves moved off of the sand bailer 900, 1000 after the drifting operation is completed.

In accordance with one or more embodiments, the outer sleeve 140 may be shifted from the first position to the second position by shearing the pins 710a, 710b that connect the outer sleeve 140 to the inner sleeve 145. The pins 710a, 710b may be sheared using a force of impact created by the interaction between the outer sleeve 140 and the obstruction 160. Further, the inner sleeve 145 may be shifted from the third position to the fourth position by shearing the pins 710a, 710b that connect the inner sleeve 145 to the sand bailer 900, 1000. The pins 710a, 710b may be sheared using a force of impact created by the interaction between the inner sleeve 145 and the obstruction 160.

In further embodiments, the inner sleeve 145 and the outer sleeve 140 are equipped with sharp edges, or cutters 810a-810e, located on the downhole portion of the sleeve. When the apparatus 110 is being run inside the conduit 102 for the tubular 170 and the obstruction 160 is encountered, the cutters 810a-810e may be used to remove the obstruction 160 from an inner wall of the tubular 170.

In this scenario, the obstruction 160 may be a weaker obstruction, such as scale, and only a small force is required to remove the obstruction 160 from the wall of the tubular 170. In particular, the force required to remove the obstruction 160 may be less than the force required to shear the pins 710a, 710b connecting the sleeves to their underlays. Thus, the obstruction 160 may be removed while retaining the size of the apparatus 110.

In further embodiments, and in S1206, a sample 1100 of the obstruction 160 is obtained by creating a suction pressure within the sand bailer 900, 100. Specifically, when the obstruction 160 is so large that it disconnects both the outer sleeve 140 and the inner sleeve 145 from the sand bailer 900, 1000 and hits the sand bailer 900, 1000, the apparatus 110 is unable to pass through the conduit 102 of the tubular 170. In accordance with one or more embodiments, the suction pressure is created in sand bailer 900 using a pump section 904 or in sand bailer 1000 using a bailer tube 1002, pressure relief hole 1006, and ball valve 1008.

In accordance with one or more embodiments, the pump section 904 may be activated to create the suction pressure in a load barrel 924 of the sand bailer 900. The pump section 904 may be activated by being set down on the obstruction 160 or by sending a signal to the pump section 904 via the deployment device 180. When the pump section 904 is activated, the piston 914 strokes upward (in a direction from the stop ring 912 to the piston stop 906). This upward movement causes a suction to occur in the load barrel 924.

In accordance with one or more embodiments, the suction causes the lower ball 928 to be pulled upward and an influx of wellbore fluid and a sample 1100 of the obstruction 160 are able to flow through the ball housing 926 and around the lower ball 928 into the load barrel 924. When the pressure equalizes, the lower ball 928 falls back into the ball housing 926 and seals the shoe 930 of the sand bailer 900.

Thus, the sample 1100 of the obstruction 160 is contained within the load barrel 924 and the sand bailer 900 may be raised to the surface and the sample 1100 may be analyzed to determine the make-up of the obstruction 160. Once the physical and chemical make-up of the obstruction 160 is determined, workover operations may be performed to clear the obstruction 160 from the tubular 170.

In other embodiments, the ball valve 1008 of sand bailer 1000 may be activated by being set down on the obstruction 160 or by sending a signal to the ball valve 1008 via the deployment device 180. When activated, the ball valve 1008 may open to allow the influx of wellbore fluid and the sample 1100 into the bailer tube 1002. The pressure relief hole 1006 may be used to equalize pressure between the bailer tube 1002 and the wellbore during this operation. Once pressure is equalized, the ball valve 1008 may close sealing the sample 1100 inside the bailer tube 1002.

Thus, the sample 1100 of the obstruction 160 is contained within the bailer tube 1002 and the sand bailer 1000 may be raised to the surface and the sample 1100 may be analyzed to determine the make-up of the obstruction 160. Once the physical and chemical make-up of the obstruction 160 is determined, workover operations may be performed to clear the obstruction 160 from the tubular 170.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. An apparatus for deployment in a conduit of a tubular having an obstruction, the apparatus comprising:

a fish neck connected to a deployment device configured to deploy the fish neck into the conduit of the tubular;

a sand bailer connected to the fish neck, wherein the sand bailer has a diameter larger than a diameter of the fish neck and the sand bailer is configured to obtain a sample of the obstruction by creating a suction pressure within the sand bailer; and an outer sleeve movable between a first position and a second position, wherein the first position comprises the outer sleeve concentrically disposed around the sand bailer and the second position comprises the outer sleeve concentrically disposed around the fish neck after an interaction between the outer sleeve and the obstruction, the outer sleeve comprising a plurality of panels connected to one another by a plurality of stretchable elements.

2. The apparatus of claim 1, further comprising:

an inner sleeve movable between a third position and a fourth position, wherein the third position comprises the inner sleeve concentrically disposed beneath the outer sleeve around the sand bailer and the fourth position comprises the inner sleeve concentrically disposed around the fish neck, the inner sleeve comprising a plurality of panels connected to one another by a plurality of stretchable elements.

3. The apparatus of claim 2, wherein the outer sleeve is movably connected to the inner sleeve via pins configured to shear due to a force of impact from the interaction between the outer sleeve and the obstruction.

4. The apparatus of claim 3, wherein the inner sleeve is movably connected to the sand bailer via pins configured to shear due to a force of impact from an interaction between the inner sleeve and the obstruction.

5. The apparatus of claim 1, wherein the outer sleeve further comprises a sharp edge on a downhole end of the outer sleeve.

6. The apparatus of claim 2, wherein the inner sleeve further comprises a sharp edge on a downhole end of the outer sleeve.

7. A method for detecting an obstruction in a conduit of a tubular, comprising:

running a deployment device connected to a fish neck and a sand bailer into the conduit of the tubular, wherein the sand bailer has a diameter larger than a diameter of the fish neck;

positioning an outer sleeve, comprising a plurality of stretchable elements connecting a plurality of panels to one another, in a first position, wherein the first position comprises the outer sleeve disposed concentrically around the sand bailer;

detecting the obstruction by shifting the outer sleeve from the first position to a second position due to an interaction between the obstruction and the outer sleeve, wherein the second position comprises the outer sleeve concentrically disposed around the fish neck; and obtaining a sample of the obstruction by creating a suction pressure within the sand bailer.

8. The method of claim 7, further comprising:

determining a size of the obstruction based on the outer sleeve shifting from the first position to the second position.

9. The method of claim 8, further comprising:

positioning an inner sleeve, comprising a plurality of stretchable elements connecting a plurality of panels to one another, in a third position, wherein the third position comprises the inner sleeve disposed concentrically around the sand bailer between the outer sleeve and the sand bailer.

10. The method of claim 9, wherein detecting the obstruction further comprises shifting the inner sleeve from the third position to a fourth position due to an interaction between the obstruction and the inner sleeve, wherein the fourth position comprises the inner sleeve concentrically disposed around the fish neck.

11. The method of claim 10, further comprising:

determining a size of the obstruction based on the inner sleeve shifting from the third position to the fourth position.

12. The method of claim 9, further comprising:

determining a size of the obstruction based on the outer sleeve shifting from the first position to the second position and the inner sleeve being retained in the third position.

13. The method of claim 9, wherein determining a size of the obstruction based on the outer sleeve shifting from the first position to the second position further comprises shearing pins that movably connect the outer sleeve to the inner sleeve, using a force of impact created by the interaction between the outer sleeve and the obstruction.

14. The method of claim 10, wherein shifting of the inner sleeve from the third position to the fourth position further comprises shearing pins that movably connected the inner sleeve to the sand bailer, using a force of impact created by the interaction between the inner sleeve and the obstruction.

15. The method of claim 7, further comprising:

removing the obstruction from an inner wall of the tubular using a sharp edge of the outer sleeve.

16. The method of claim 9, further comprising:

removing the obstruction from an inner wall of the tubular using a sharp edge of the inner sleeve.

17. A system for detecting an obstruction in a conduit of a tubular comprising:

a deployment device connected to a fish neck and a sand bailer, wherein the sand bailer has a diameter larger than a diameter of the fish neck and the sand bailer is configured to obtain a sample of the obstruction by creating a suction pressure within the sand bailer; and a first cylindrical sleeve stretchable to be disposed concentrically around the sand bailer, wherein the first cylindrical sleeve is configured to:

disconnect from a first underlay due to a force of impact created by an interaction with the obstruction; and contract and shift around the fish neck, wherein the system detects the obstruction by a contraction of the first cylindrical sleeve.

18. The system of claim 17, wherein the first underlay further comprises the sand bailer and the system allows the deployment device to move past the obstruction after the contraction of the first cylindrical sleeve.

19. The system of claim 17, further comprising:

a second cylindrical sleeve stretchable to be disposed concentrically around the sand bailer, beneath the first cylindrical sleeve, wherein the first underlay further comprises the second cylindrical sleeve and the second cylindrical sleeve is configured to:

disconnect from a second underlay due to the force of impact created by the interaction with the obstruction; and contract and shift around the fish neck, wherein the system detects the obstruction by a contraction of the first cylindrical sleeve and the second cylindrical sleeve.

20. The system of claim 17, further comprising:

a second to an n-th cylindrical sleeves stretchable to be disposed concentrically around the sand bailer, beneath the first cylindrical sleeve, wherein n is an integer greater than 2, wherein the second to the n-th cylindrical sleeves are configured to:

disconnect from an underlay due to a force of impact created by the interaction with the obstruction; and contract and shift around the fish neck.

* * * * *